US007156012B2

(12) United States Patent
Komazaki et al.

(10) Patent No.: US 7,156,012 B2
(45) Date of Patent: Jan. 2, 2007

(54) PNEUMATICALLY OPERATED FASTENER DRIVING TOOL

(75) Inventors: Yoshiichi Komazaki, Hitachinaka (JP); Yoshinori Ishizawa, Hitachinaka (JP); Masashi Nishida, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 99 days.

(21) Appl. No.: 11/038,115

(22) Filed: Jan. 21, 2005

(65) Prior Publication Data

US 2005/0156008 A1 Jul. 21, 2005

(30) Foreign Application Priority Data

Jan. 20, 2004 (JP) ..... P2004-011835
Mar. 18, 2004 (JP) ..... P2004-078201

(51) Int. Cl.
*F01L 25/04* (2006.01)

(52) U.S. Cl. ..... 91/304; 91/461; 60/413

(58) Field of Classification Search ..... 60/413; 91/304, 308, 456, 461
See application file for complete search history.

(56) References Cited

U.S. PATENT DOCUMENTS 2,713,165 A * 7/1955 Campbell et al. ..... 91/457
3,200,716 A * 8/1965 Le Sage ..... 91/461
3,583,496 A * 6/1971 Fehrs ..... 91/308
3,808,620 A * 5/1974 Rothfuss et al. ..... 91/308
5,085,126 A 2/1992 Mukoyama
5,715,986 A * 2/1998 Sauer ..... 227/130

FOREIGN PATENT DOCUMENTS

| | | |
|---|---|---|
| JP | 54-023274 | 2/1979 |
| JP | 3-208569 | 9/1991 |
| JP | 32-08569 | 9/1991 |
| JP | 5-138548 | 6/1993 |
| JP | 51-38548 | 6/1993 |
| JP | 11-033930 | 2/1999 |

* cited by examiner

*Primary Examiner*—Igor Kershteyn
(74) *Attorney, Agent, or Firm*—Antonelli, Terry, Stout and Kraus, LLP.

(57) ABSTRACT

A pneumatically operated fastener driving tool capable of reducing a time period from operation timing of a trigger to downward movement of a driver blade for fastener driving, and reducing a time period from the release timing of the trigger to a timing at which respective components are returned to their initial positions for a subsequent nail driving. As components a main valve and a trigger valve is provided. The main valve is movable within a main valve chamber connected to a main valve control channel. The trigger valve selectively provides fluid communication between the accumulator and a main valve chamber through the main valve control channel and between the main valve chamber and the atmosphere through the main valve control channel. A ratio of cross-sectional area of the main valve control channel to an internal volume of the main valve chamber is defined to a specified ratio.

31 Claims, 16 Drawing Sheets

13
8
2
4a
33
0.74 3.0
6.1 7.1
11.3
(pa)
(m)
(ms)
A
B
C
D
E
F
G

13'
8'
2'
4a'
33'
0.85
11.3
22.4
23.1
27.1
(pa)
(m)
(ms)
A'
B'
C'
D'
E'
F'
G 8
2
4a
13
33
0.7
35.7
6.9
11.3
20.3
18.6
21.4
25.2
41.8
70.6
(pa)
(m)
(ms)
A
D
H
(I)
F
J
K
G
L
M

8'
2'
4a'
13'
33'
0.85
22.2
22.1
26.9
37.4
35.2
38.9
44.3
60.3
86.2
(pa)
(m)
(ms)
A'
D'
H'
I'
F'
J'
K'
G'
L'
M'

PNEUMATICALLY OPERATED FASTENER DRIVING TOOL

BACKGROUND OF THE INVENTION

The present invention relates to a fastener driving tool such as a nail gun driven by compressed air, and more particularly, to such fastener driving tool improving drive response and decreasing air consumption.

Heretofore, fastener driving tools such as nail guns have existed which drive fasteners such as nails or staples using compressed air as the power source. In such fastener driving tools, compressed air is supplied to a piston upper chamber defined by an inner surface of a cylinder and a piston for rapidly displacing the piston to perform nailing. Compressed air is supplied from an external source and temporarily stored in an accumulator formed within a frame of the nail gun. The accumulator and the piston upper chamber are connected by a channel, but one or more valves which are switched between open and shut-off positions are provided along this channel. These valves are designed to open or shut-off the channel by supplying or expelling compressed air in valve chambers constituted by the spaces each adjacent to each valve. Typically the structure is such that a first valve is activated as a result of external operation of a trigger or the like, and this operation allows a downstream passage to be communicated with or to be shut-off from the first valve. Thus, a downstream valve chamber is brought into communication with or shutting-off from the upstream passage, thereby sequentially activating or deactivating the downstream valves.

In addition, a time period starting from completion of the nail driving operation to restoration to an initial state for the next nailing operation is dependent upon the circulation speed of the compressed air in the fastener driving tool after the trigger is released, and the movement speed of the valves in proportion to this circulation speed. That is, the time period is dependent on the shut-off speed for shutting off the piston upper chamber in the cylinder from the accumulator by a valve caused by, after releasing the trigger or the like, circulation of the compressed air through the channel in the fastener driving tool as a result of the returning motion of a plunger which had been pressed by this trigger.

In a conventional fastener driving tools as disclosed in Japanese Patent Publication No.S58-50833, valve activation is performed sequentially from valves whose valve chamber volume is small to valves with large valve chamber in order to stabilize operation of the valves irrespective of the speed with which the trigger is pulled. Since with this structure the valves are sequentially activated by compressed air, a time period starting from pulling the trigger and/or pushing operation of a push lever against a workpiece to a start of the nailing driving motion is highly dependent upon the time required to sequentially activate the valves.

In order to reduce this time period and increase response, Japanese Patent Publication No. H7-112674 discloses a nail gun, in which a main valve is divided into first and second valves, so that kinetic energy of the first valve is utilized to improve the operating speed of the second valve.

With this structure in which the main valve is divided into two valves, only the time period from when the second valve begins to move until it moves to maximum displacement is reduced. The time period from both pulling the trigger and pushing the push lever onto the workpiece to the operation timing of the first valve is still not reduced. In addition, since only the time period from when the second valve begins to move until it moves to maximum displacement is reduced, it was only possible to reduce the time period from when the trigger is pulled until nailing is performed. Consequently, a time period from the completion timing of the nail driving operation to the start timing of the next nail driving operation cannot be reduced when continuous nailing is performed. That is, a response cannot be improved.

Laid-open Japanese Patent Application Kokai No. H11-33930 discloses a structure in which, an internal volume of a main valve chamber for accommodating therein a main valve is increased. With this arrangement, air damping behavior due to compression of the main valve chamber does not occur when the main valve rises and is contained in the main valve chamber.

With this structure in which the volume of the main valve chamber is increased, the amount of compressed air accumulated in the main valve chamber increases. For this reason, the time period for discharging the compressed air out of the main valve chamber is increased, which degrades the response.

Laid-open Japanese Patent Application Kokai No. H5-138548 discloses communication of a piston lower chamber with a trigger valve chamber. The movement speed of a valve piston and a main valve are increased as a result of the pressure which is generated from the movement of the piston.

With this structure in which the piston lower chamber and trigger valve chamber are connected, at the instant that the piston passes through the one-way valve disposed at an intermediate region of the cylinder, compressed air flows into the trigger valve chamber and closes the main valve. Therefore, the nailing force was reduced. Moreover, extremely complicated structure results.

Another conventional fastener driving tool has been proposed. The tool includes a trigger valve and main valve. A trigger valve exterior frame internally defines a trigger valve chamber. The trigger valve includes a plunger extending through the trigger valve exterior frame and the trigger valve chamber and slidably movable as a result of the movement of the trigger and the abutment of the push lever against the workpiece. The movement of the plunger selectively shuts off a fluid communication between the accumulator and the trigger valve chamber and between the trigger valve chamber and an atmosphere. However, the resultant arrangement cannot provide high response for discharging compressed air from the main valve.

Still another conventional fastener driving tool is proposed in which a main valve is not provided, but a trigger valve is additionally equipped with a valve piston. The valve piston is reciprocably slidably disposed in a trigger valve exterior frame, and has one side in the sliding direction facing the accumulator. The valve piston alternately opens and blocks a channel from the piston upper chamber connected to the trigger valve exterior frame to the accumulator and a channel from the piston upper chamber to the atmosphere. With this fastener driving tool, the displacement of the valve piston serves to select the air channel and control the nailing of the fastener. However, the speed of the displacement of the valve piston is low, and the delay in the displacement of this valve piston can cause other control to be delayed as well. Consequently, the problem arises that the time lag from when the operator begins the nailing operation until the fastener is actually driven becomes large, response becomes poor to lower workability. In addition, the problem arises that when many fasteners are to be driven in a short period of time, the aforementioned time lag makes continuous nailing difficult to perform.

In addition, with the conventional fastener driving tools, after nailing, in order to return the piston to the pre-nailing position, the piston upper chamber and the atmosphere are communicated with each other for releasing the compressed to the atmosphere, while the valve is closed for preventing the compressed air from flowing from the accumulator into the piston upper chamber.

However, during the period from when the valve begins to close until it is completely closed, the accumulator and the piston upper chamber are communicated with each other, and the piston upper chamber and the atmosphere are also communicated with each other. Accordingly, the compressed air in the accumulator would in some cases flow unnecessarily into the piston upper chamber and is expelled into the atmosphere. This causes an increase in air consumption, which consequently requires a high-performance compressor or the like to produce compressed air.

SUMMARY OF THE INVENTION

It is therefore an object of the present invention is to provide a fastener driving tool improving the response and continuous shots or nailing performance in nailing work, yet reducing the consumption of compressed air.

This and other objects of the present invention will be attained by A fastener driving tool including a frame, a cylinder, a piston, a main valve, a main valve chamber section, a trigger valve, and a main valve control channel section. The frame defines therein an accumulator that accumulates a compressed air. The cylinder is disposed within the frame. The piston is reciprocally slidably disposed within the cylinder. A piston upper chamber is defined by an inner peripheral surface of the cylinder and an upper surface of the piston. The main valve alternately opens and blocks a fluid communication between the piston upper chamber and the accumulator. The main valve chamber section defines therein a main valve chamber in which the main valve is movably disposed. The main valve chamber provides a maximum internal volume. The trigger valve alternately opens and blocks a fluid communication from the accumulator to the main valve chamber, and a fluid communication from the main valve chamber to an atmosphere. The main valve control channel section defines therein a main valve control channel that provides a fluid connection between the main valve chamber and the trigger valve. A value obtained from dividing the maximum internal volume of the main valve chamber by a cross-sectional area of the main valve control channel being not more than 1.0.

In another aspect of the invention, there is provided a fastener driving tool including a frame, a cylinder, a piston, a trigger, and a trigger valve provided with a trigger valve exterior frame, a valve piston and a plunger. The frame defines therein an accumulator for accumulating a compressed air. The cylinder is disposed within the frame. The piston is reciprocally slidably disposed within the cylinder. A piston upper chamber is defined by the frame, an inner peripheral surface of the cylinder and an upper surface of the piston. The trigger functions as an operation input member. A trigger valve alternately opens and blocks a fluid communication between the piston upper chamber and the accumulator and a fluid communication between the piston upper chamber and an atmosphere. The trigger valve exterior frame is in fluid communication with the piston upper chamber and is formed with a through hole. The valve piston is reciprocably slidably disposed in the trigger valve exterior frame. The valve piston is movable between its top dead center where piston upper chamber is communicated with the atmosphere and its bottom dead center where the piston upper chamber is communicated with the accumulator. The valve piston has a first section exposed to the accumulator and formed with a trigger valve intake channel opened to the accumulator and a second section in sliding contact with the trigger valve exterior frame. A trigger valve chamber is defined by the second section and the trigger valve exterior frame and provides a maximum internal volume. The plunger is movable between its top dead center and its bottom dead center and has a first portion associated with the valve piston and a second portion associated with the through hole. A trigger valve control channel is formed between the second portion and the through hole and has a cross-sectional area. The trigger valve control channel is opened when the plunger is moved to its top dead center. A value obtained from dividing the maximum volume of the trigger valve chamber measured in $m^3$ by the cross-sectional area of the trigger valve control channel is not more than 0.20.

Further, in the fastener driving tool including the frame, the cylinder, the piston, the trigger, and the trigger valve provided with the trigger valve exterior frame, the valve piston and the plunger, the trigger valve intake channel has a cross-sectional area of not less than $2.75\times10^{-6}$ $m^2$, and the trigger valve chamber has a maximum internal volume of $4.0\times10^{-7}$ $m^3$.

BRIEF DESCRIPTION OF THE DRAWINGS

In the drawings;

FIG. 20(*b*) is a graph showing the relationship between the time and a displacement of a main valve according to the first embodiment;

FIG. 20(*c*) is a graph showing the relationship between the time and a displacement of a valve piston according to the first embodiment;

FIG. 20(*d*) is a graph showing the relationship between the time and a displacement of a piston according to the first embodiment;

FIG. 21(*b*) is a graph showing the relationship between the time and a displacement of a main valve according to the comparative fastener driving tool;

FIG. 21(*c*) is a graph showing the relationship between the time and a displacement of a valve piston according to the comparative fastener driving tool;

FIG. 21(*d*) is a graph showing the relationship between the time and a displacement of a piston according to the comparative fastener driving tool;

FIG. 22(*b*) is a graph showing the relationship between the time and a displacement of a main valve according to the first embodiment;

FIG. 22(*c*) is a graph showing the relationship between the time and a displacement of a valve piston according to the first embodiment;

FIG. 22(*d*) is a graph showing the relationship between the time and a displacement of a piston according to the first embodiment;

FIG. 22(*e*) is a graph showing the relationship between the time and a displacement of a tool itself according to the first embodiment;

FIG. 23(*b*) is a graph showing the relationship between the time and a displacement of a main valve according to the comparative fastener driving tool;

FIG. 23(*c*) is a graph showing the relationship between the time and a displacement of a valve piston according to the comparative fastener driving tool;

FIG. 23(*d*) is a graph showing the relationship between the time and a displacement of a piston according to the comparative fastener driving tool; and FIG. 23(*e*) is a graph showing the relationship between the time and a displacement of a tool itself according to the comparative fastener driving tool.

DETAILED DESCRIPTION OF THE PREFERRED EMBODIMENTS

Figure 1:
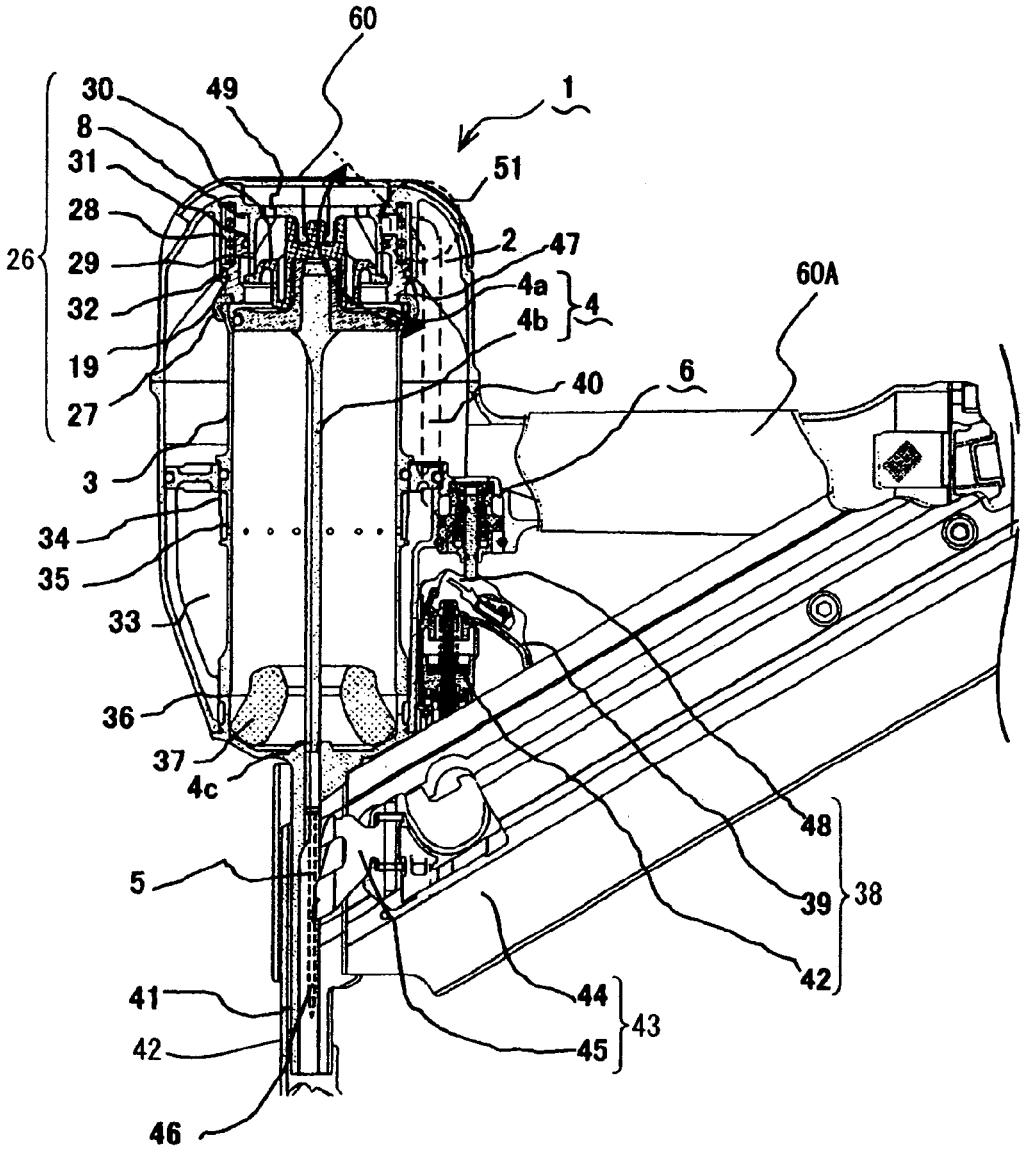
FIG. 1 is a cross-sectional view of the fastener driving tool according to the first embodiment of the present invention.

A fastener driving tool according to a first embodiment of the present invention will be described with reference to FIGS. 1 through 11. The fastener driving tool shown in FIG. 1 is a nail gun 1 which uses compressed air as the power source. The nail gun 1 includes a frame 60, a handle 60A disposed at one side of the frame 60, and a nose 41 disposed at a lower end of the frame 60. These frame 60, handle 60A and nose 41 are provided as an integral unit to form an outer frame. An accumulator 2 is formed within the handle 60A and frame 60 for accumulating therein a compressed air delivered from a compressor (not shown) through an air hose (not shown). A cylinder 3 is provided within the frame 60, and a piston 4*a* is reciprocally movably provided and slidably within the cylinder 3. A driver blade 4*b* is provided integrally with the piston 4*a*, and has a free end 4*c* for abutting against the fastener 5 for driving.

A return chamber 33 which accumulates therein a compressed air to return the driver blade 4*b* to its upper dead center is provided around the lower outer peripheral surface of the cylinder 3. A one-way valve 34 is provided in an axially intermediate portion of the cylinder 3. An air channel 35 is formed in the cylinder 3 for allowing the compressed air to flow in only one direction, i.e., from inside the cylinder 3 to the return air chamber 33, outside the cylinder 3. In addition, an air channel 36 is formed at a lower portion of the cylinder 3 for providing continuous communication between the cylinder 3 and the return chamber 33. In addition, a piston bumper 37 is provided at the bottom of the cylinder 3 for absorbing excess energy from the driver blade 4*b* after nailing the fastener 5.

Figure 2:
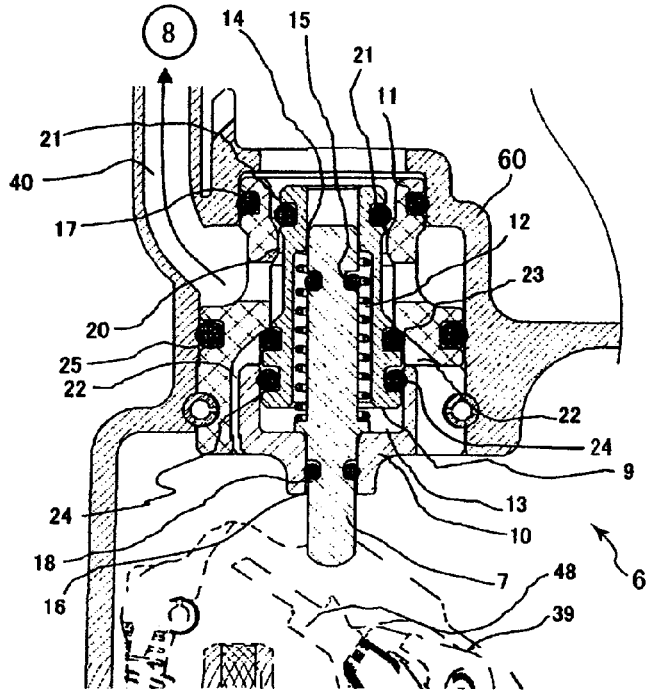
FIG. 2 is an enlarged cross-sectional view of a trigger valve in the fastener driving tool according to the first embodiment.

An operating portion 38 is provided at the base of the handle 60A. This operating portion 38 includes a trigger 39 operated by the user, an arm plate 48 which is attached pivotally movably to the trigger 39, and a push lever 42 which projects from the bottom of the nose 41 and extends to the vicinity of the arm plate 48. The push lever 42 is movable along the nose 41 and is biased away from the frame 60. In addition, a trigger valve 6 is provided at the base of the handle 60A and in confrontation with the trigger 39. As is well known in the art, the structure is such that, when both the trigger 39 is pulled and the push lever 42 is pressed against the workpiece, a plunger 7 on the trigger valve 6 is pushed upward, as shown in FIG. 2, by a linking mechanism of the arm plate 48 and the trigger 39.

A nail injection section 43 provided in conjunction with the nose 41 includes a magazine 44 and a feed mechanism 45. The magazine 44 is loaded with fasteners 5 arrayed side by side. The feed mechanism 45 is adapted for successively feeding fasteners 5 loaded in the magazine 44 to an injection opening 46 at the nose 41. The trigger valve 6 shown in FIG. 1 and FIG. 2 mainly includes an outer valve bush 10, an inner valve bush 11, a valve piston 9, a plunger 7, and a spring 12. The outer valve bush 10 and inner valve bush 11 are fixed to the frame 60 to form a trigger valve exterior frame which constitutes an outer wall of the trigger valve. The valve piston 9 is provided reciprocably slidably within the outer valve bush 10 and inner valve bush 11. The valve piston 9 and the outer valve bush 10 are formed with through holes, so that the plunger 7 is provided reciprocably slidably with respect to the through holes. The plunger 7 has a bottom end in contact with the arm plate 48. The spring 12 is interposed between the valve piston 9 and the plunger 7 for biasing the valve piston 9 and the plunger 7 in opposite directions, i.e., for biasing the valve piston 9 upward while biasing the plunger 7 downward.

The trigger valve 6 is fluidly connected to a main valve control channel 40, which is a cylindrical tube extending from a main valve chamber 8 described later. Specifically, the main valve control channel 40 is fluidly connected to a space between the outer valve bush 10 and inner valve bush 11, and opens into the trigger valve 6. This main valve control channel 40 is configured such that its cross-sectional area S1 is $3.2\times10^{-5}$ ($m^2$).

In addition, O-rings 17 and 25 are fitted on the inner valve bush 11. The O-ring 17 is adapted for continually blocking fluid connection between the accumulator 2 and the main valve control channel 40. The O-ring 25 is adapted for continually blocking fluid connection between the main valve control channel 40 and an atmosphere.

One side of the valve piston 9 in the sliding direction faces the accumulator 2, and the inner valve bush 11 has an accumulator side and an atmospheric side. An outer diameter at an accumulator side of the valve piston 9 is smaller than an inner diameter of the accumulator side of the inner valve bush 11 to define therebeween a main valve intake channel 20. Further, an outer diameter at an atmospheric side of the valve piston 9 is smaller than an inner diameter of the atmospheric side of the inner valve bush 11 to define therebetween an air channel 22. Further, an O-ring 21 and an O-ring 23 are disposed at the accumulator side and atmospheric side of the valve piston 9, respectively, for selectively blocking the respective channels 20 and 22.

Consequently, the main valve intake channel 20 passes between the valve piston 9 and the inner valve bush 11 to provide fluid communication between the accumulator 2 and the main valve control channel 40 when the O-ring 21 is out of contact from the inner valve bush 11. Further, the air channel 22 passes between the valve piston 9 and the inner valve bush 11 to provide fluid communication between the main valve control channel 40 and the atmosphere when the O-ring 22 is out of contact from the inner valve bush 11. This air channel 22 is formed such that its cross-sectional area extending perpendicular to a flowing direction is larger than that of the main valve channel 40. As a result, the flow resistance at the air channel 22 will be lower than that of the main valve channel 40. The main valve intake channel 20 and air channel 22 are alternately opened and blocked due to the vertical sliding of the valve piston 9. In addition, the main intake control channel 20 is formed such that its cross-sectional area Sm is $3.2\times10^{-5}$ ($m^2$).

A trigger valve chamber 13 is defined by another side (lower side) of the valve piston 9 in the sliding direction and the outer valve bush 10. This trigger valve chamber 13 has an internal volume variable due to the sliding movement of the valve piston 9, and is formed such that a maximum internal volume V2 defined when the valve piston 9 is at the top dead center is $4.0\times10^{-7}$ ($m^3$). In addition, an O-ring 24 is fitted onto the valve piston 9 for continually blocking the fluid connection between the air channel 22 and the trigger valve chamber 13.

The plunger 7 extends through the trigger valve chamber 13, and a top end faces the accumulator 2. The valve piston 9 has first and second sliding regions relative to the valve piston 9 and the outer valve bush 10, and O-ring grooves are formed at the respective sliding regions for installing therein an O-ring 15 and an O-ring 18 for maintaining hermetic seal. An outer diameter of the first sliding region is smaller than an inner diameter of the valve piston 9 for defining therebetween a trigger valve intake channel 14, and an outer diameter of the second sliding region is smaller than an inner diameter of the outer valve bush 10 for defining therebetween a trigger valve control channel 16.

Consequently, the trigger valve intake channel 14 passes between the plunger 7 and the valve piston 9 for providing fluid communication from the accumulator 2 to the trigger valve chamber 13 when the O-ring 15 is out of contact from the valve piston 9. Further, the trigger valve control channel 16 passes between the plunger 7 and the outer valve bush 10 to provide fluid communication from the trigger valve chamber 13 to the atmosphere when the O-ring 18 is out of contact from the outer valve bush 10. The trigger valve intake channel 14 and trigger valve control channel 16 are alternately opened and blocked in accordance with the sliding motion of the plunger 7.

The trigger valve intake channel 14 is formed such that its cross-sectional area St is $2.75\times10^{-6}$ ($m^2$). Further, the trigger valve control channel 16 is formed such that its cross-sectional area S2 is $1.98\times10^{-6}$ ($m^2$). As a result, the value obtained from dividing the volume of the trigger valve chamber 13 by the cross-sectional area of the trigger valve control channel 16 is V2/S2=0.2.

The structure of the trigger valve 6 is such that, when the valve piston 9 is positioned toward the top dead center (for example FIG. 2), the main valve intake channel 20 is opened so that the accumulator 2 and the main valve control channel 40 are communicated with each other, while air channel 22 is closed by the O-ring 23 so that fluid communication between the main valve control channel 40 and the atmosphere is blocked. In addition, when the valve piston 9 is positioned toward the bottom dead center (for example FIG. 5), the main valve intake channel 20 is closed by the O-ring 21, so that fluid communication between the main valve control channel 40 and the accumulator 2 is blocked, while air channel 22 is opened so that and the main valve control channel 40 and the atmosphere are communicated with each other.

When the plunger 7 is positioned toward the top dead center (FIG. 5), the trigger valve control channel 16 is opened so that the trigger valve chamber 13 is communicated with the atmosphere, while the trigger valve intake channel 14 is closed by the O-ring 15 so that fluid communication between the accumulator 2 and the trigger valve chamber 13 is blocked. In addition, when the plunger 7 is positioned toward the bottom dead center (FIG. 2), the trigger valve control channel 16 is closed by the O-ring 18, so that fluid communication between the trigger valve chamber 13 and the atmosphere is blocked, while the trigger valve intake channel 14 is opened so that the accumulator 2 and the trigger valve chamber 13 are communicated with each other.

Figure 3:
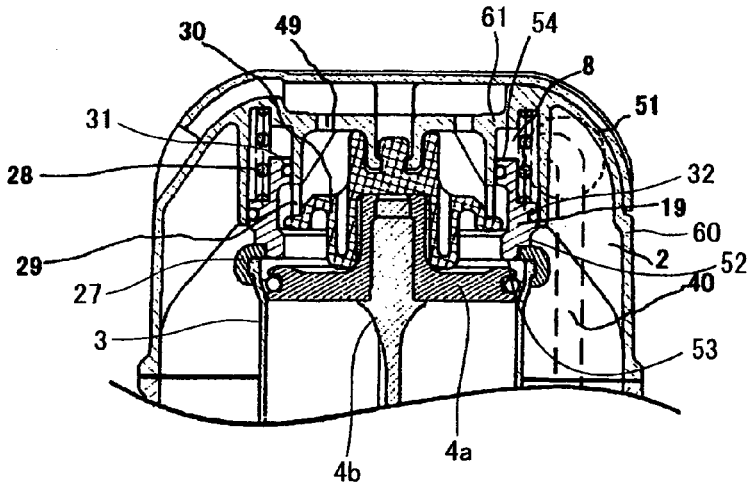
FIG. 3 is a partial cross-sectional view particularly showing a main valve in the fastener driving tool according to the first embodiment.

A main valve section 26 is provided immediately above and around the outer peripheral surface of the cylinder 3 as shown in FIGS. 1 and 3. The main valve section 26 generally includes a main valve 19, a main valve rubber 27, a main valve spring 28, and an exhaust rubber 30. The main valve rubber 27 is fitted to the top end of the cylinder 3. The main valve spring 28 is adapted for biasing the main valve 19 toward its bottom dead center. The exhaust rubber 30 is placed above the cylinder 3. An air discharge passage 29 is formed above the cylinder 3 for discharging the compressed air in the piston upper chamber above the piston 4*a*. The exhaust rubber 30 is adapted for shutting off the air discharge passage 29 when the main valve 19 is coming into contact with the exhaust rubber 30. In addition, the upper end of the frame 60 is formed with an exhaust hole 49 to which the air passage 29 is connected. Thus, the compressed air in the piston upper chamber can be discharged to the atmosphere.

A main valve sectioning region 61 is provided as an upper part of the frame 60. The main valve sectioning region 61 provides a main valve chamber 8 in which the main valve 19 is vertically slidably movably provided. The main valve chamber 8 is in communication with the main valve control channel 40.

The main valve 19 has top and middle portions provided with O-rings 31 and 32, respectively. The O-ring 31 is adapted for continually blocking fluid communication between the main valve chamber 8 and the air channel 29, and the O-ring 32 is adapted for continually blocking fluid communication between the main valve chamber 8 and the accumulator 2. Thus, the main valve chamber 8 is hermetically maintained by these O-rings 31 and 32.

The main valve chamber 8 has an internal volume variable in accordance with the vertical movement of the main valve 19, but has a maximum volume V1 of $2.56\times10^{-5}$ ($m^3$). As a result, the value obtained from dividing the volume V1 of the main valve chamber 8 by the cross-sectional area S1 of the main valve control channel 40 is $V1/S1=0.8\leqq1.0$. Likewise, the value obtained from dividing the volume V1 of the main valve chamber 8 by the cross-sectional area Sm of the main valve intake channel 20 is $V1/Sm=0.8\leqq1.0$. In addition, the main valve control channel 40 has a curving portion as shown at the location enclosed by a circle in FIG. 3. The curving portion is formed into a gentle arc shape.

When the main valve 19 is positioned toward the top dead center, the main valve 19 comes into contact with the exhaust rubber 30 to shut off the air exhaust passage 29, so that fluid communication between the piston upper chamber of the cylinder 3 and the atmosphere is blocked, while the piston upper chamber of the cylinder 3 and the accumulator 2 are communicated with each other. On the other hand, when the main valve 19 is positioned toward the bottom dead center, the main valve 19 comes into contact with the main valve rubber 27 for blocking fluid communication between the piston upper chamber of the cylinder 3 and the accumulator 2, while the main valve 19 separates from the exhaust rubber 30 for opening the air exhaust passage 29, so that the piston upper chamber of the cylinder 3 is communicated with the atmosphere.

The nail driving operation will be described. FIG. 1 to FIG. 3 show state in which compressed air from the compressor (not shown) is accumulated in the accumulator 2 through the hose (not shown). In this state, as shown in FIG. 2, the plunger 7 is positioned at the bottom dead center, since the pressure within the accumulator 2 acts on the upper surface of plunger 7, and since biasing force of the spring 12 is imparted on the plunger 7. Since the plunger 7 is positioned at the bottom dead center, the trigger valve intake channel 14 is open to provide fluid communication between the accumulator 2 and the trigger valve chamber 13. At the same time, the trigger valve control channel 16 is closed by the O-ring 18, so the fluid connection between the trigger valve chamber 13 and the atmosphere is blocked. As a result, a part of the compressed air in the accumulator 2 flows through the trigger valve intake channel 14 and into the trigger valve chamber 13, and air in the trigger valve chamber 13 has the same pressure as in the accumulator 2.

In this case, because of the biasing force of the spring 12 and the difference in pressure receiving areas of the valve piston 9, the valve piston 9 is positioned at its top dead center. Therefore, the main valve intake channel 20 is open to communicate the accumulator 2 with the main valve control channel 40. At the same time, the air channel 22 is closed by the O-ring 23, so the connection between the main valve control channel 40 and the atmosphere is blocked. As a result, a portion of the compressed air in the accumulator 2 flows into the main valve control channel 40, and air accumulates in the main valve chamber 8 at the same pressure as in the accumulator 2.

Since the part of the compressed air in the accumulator 2 flows into the main valve chamber 8, the main valve 19 is positioned at the bottom dead center as shown in FIG. 3 as a result of downward pressing load arising from the difference in pressure receiving areas between the lower peripheral surface 52 and the upper end surface 54 of the main valve 19, along with the biasing force of the main valve spring 28.

Since the main valve 19 is positioned at the bottom dead center, the main valve 19 comes into contact with the main valve rubber 27 while separating from the exhaust rubber 30 to open the air discharge passage 29. As a result, the piston upper chamber of the cylinder 3 is brought into communication with the atmosphere. Thus, the piston upper chamber assumes the atmospheric pressure. In addition, the fluid connection between the piston upper chamber of the cylinder 3 and the accumulator 2 is blocked. Thus, compressed air in the accumulator 2 does not flow into the piston upper chamber. As a result, the piston 4*a* is maintained at its top dead center position.

Figure 4:
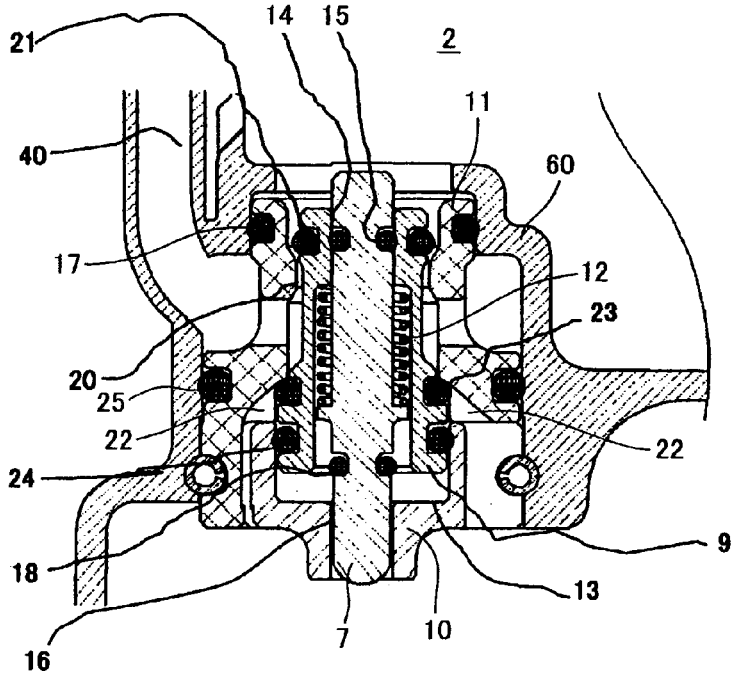
FIG. 4 is an enlarged cross-sectional view particularly showing the trigger valve in the fastener driving tool according to the first embodiment, with a plunger having been pushed upward.

FIG. 4 shows the state where the plunger 7 is pushed up to the top dead center by pulling the trigger 39 and pressing the push lever 42 against the workpiece. Since the plunger 7 is positioned at the top dead center, the O-ring 18 loses its sealing effect, and the trigger valve control channel 16 will be opened. As a result, the trigger valve chamber 13 and the atmosphere are communicated with each other, so the inside of the trigger valve chamber 13 assumes the atmospheric pressure. In addition, the trigger valve intake channel 14 is closed by the O-ring 15 for blocking fluid communication between the accumulator 2 and the trigger valve chamber 13. Thus, compressed air does not any more flow from the accumulator 2 into the trigger valve chamber 13.

Figure 5:
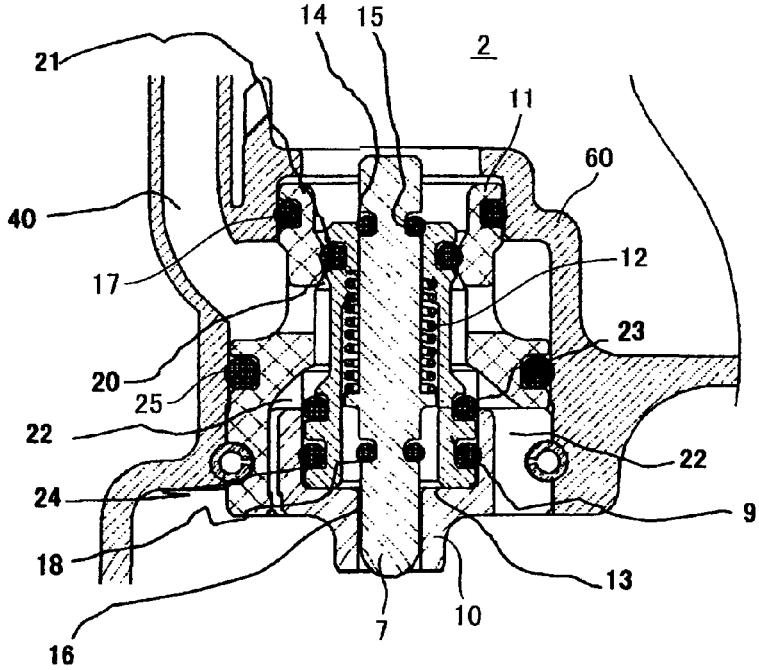
FIG. 5 is an enlarged cross-sectional view particularly showing the trigger valve in the fastener driving tool according to the first embodiment, with the plunger having been pushed upward and a valve piston then having moved to its bottom dead center.

Since the trigger valve chamber 13 assumes the atmospheric pressure, a difference arises between the pressure imparted to the valve piston 9 at its accumulator side and the pressure imparted to the valve piston 9 in the trigger valve chamber 13. Because of the pressure difference, the valve piston 9 moves to the bottom dead center as shown in FIG. 5.

The value obtained from dividing the maximum volume V2 of the trigger valve chamber 13 by the cross-sectional area S2 of the trigger valve control channel 16 is V2/S2=0.2. This value is set smaller than that in conventional fastener driving tools. This is a design concept obtained as a result of recognition of the principle in a tube flow that there is a proportional relationship between the mass rate of flow and the cross-sectional area of the tube. More specifically, it is based on the discovery that, with fastener driving tools which have valve chambers, the time period required for the pressure in these valve chambers to drop to a specific pressure due to the discharge of air decreases in accordance with an increase in the cross-sectional area of the channels used to discharge air with respect to the volume of these valve chambers.

Figure 6:
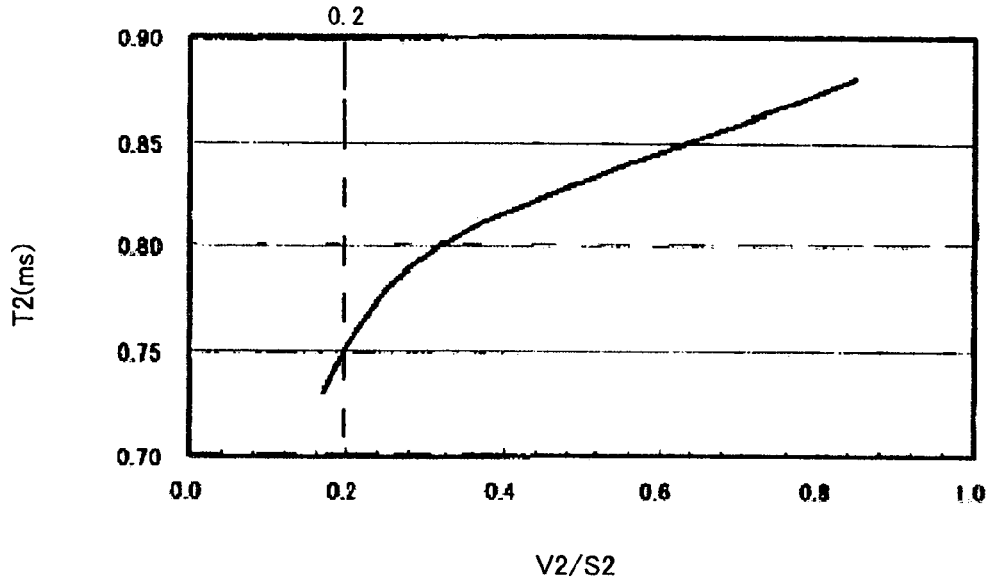
FIG. 6 is a graph showing the relationship between a valve piston displacement time (T2) and a ratio of volume (V2) of trigger valve chamber to a cross-sectional area (S2) of a trigger valve control channel in the fastener driving tool according to the first embodiment.

FIG. 6 shows the relationship between V2/S2 and the time period T2 from when the pressure inside the trigger valve chamber 13 begins to drop until the valve piston 9 moves to maximum displacement. The smaller V2/S2 is made, the smaller T2 becomes as well. For the value in this first embodiment, V2/S2=0.2, T2 is approximately 0.75 ms. Consequently, the time period required for the pressure in the trigger valve chamber 13 to drop to a specific pressure decreases, and accordingly, time period from when the plunger 7 is pressed until the valve piston 9 moves to maximum displacement can be reduced. As a result, the amount of time from when the trigger 39 and the push lever 42 are operated until the nailing motion occurs due to the displacement of the trigger valve can be further reduced. Incidentally, by making V2/S2=0.15, T2 can be made smaller, and by making V2/S2=0.10, T2 can be made smaller still, and the amount of time until the nailing motion occurs can be shortened.

Thus, by setting the maximum volume V2 of the trigger valve chamber 13 and the cross-sectional area S2 of the trigger valve control channel 16 to the aforementioned values, discharge of the compressed air from the trigger valve chamber 13 can be promptly performed, and the time period until the trigger valve chamber 13 assumes the atmospheric pressure can be reduced. Furthermore, since the discharge of air from the trigger valve chamber 13 can be improved when the valve piston 9 is moved to the bottom dead center, a so-called air damper in which the pressure in the trigger valve chamber 13 impedes the movement of the valve piston 9 is not readily formed. Accordingly, the valve piston 9 can be moved immediately from the top dead center to the bottom dead center without being interrupted by the air damper. Incidentally, even though the valve piston 9 is biased toward the top dead center by the spring 12, the valve piston 9 is movable to the bottom dead center by the pressure difference since the biasing force of the spring 12 is set beforehand to be weaker than the force caused by the pressure difference.

As shown in FIG. 5, since the valve piston 9 is positioned at the bottom dead center, the main valve intake channel 20 is closed by the O-ring 21 to block fluid communication from the accumulator 2 to the main valve control channel 40. In addition, the O-ring 23 loses its sealing effect to open the air channel 22, so that the main valve control channel 40 is brought into communication with the atmosphere. As a result, the main valve control channel 40 and the main valve chamber 8 assume atmospheric pressure.

Figure 8:
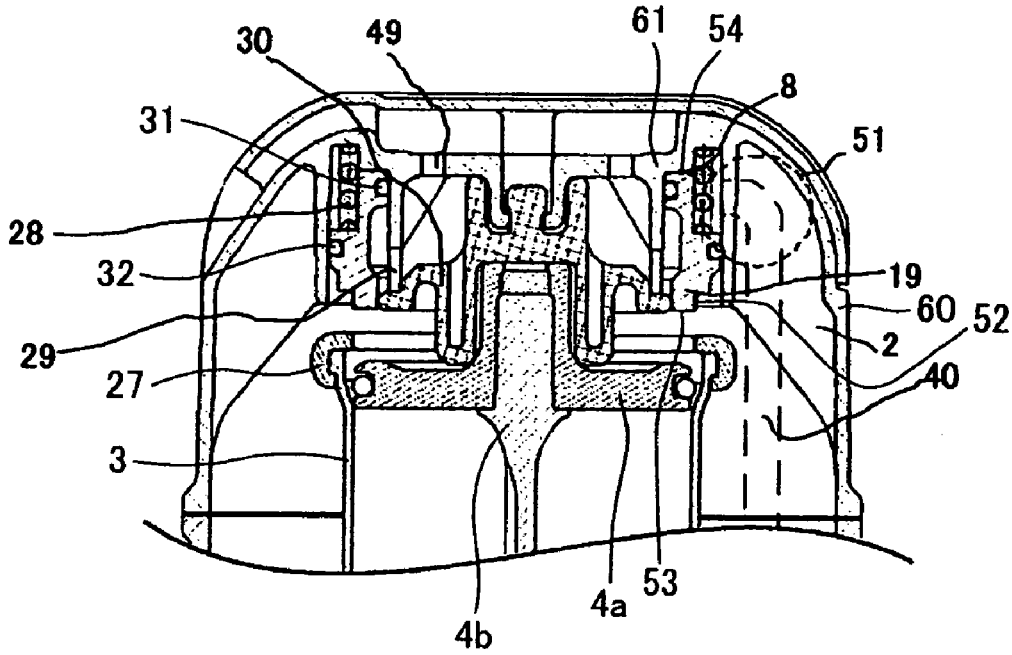
FIG. 8 is a partial cross-sectional view particularly showing the main valve in the fastener driving tool according to the first embodiment, with the main valve having moved to the top dead center.

When the main valve chamber 8 assumes generally the atmospheric pressure, the main valve 19 then moves to the top dead center as shown in FIG. 8 as a result of the upward pressure arising from the difference in pressure receiving areas at the lower outer peripheral surface 52 and at the upper end surface 54 of the main valve 19. When the main valve 19 begins to move toward the top dead center, the accumulator 2 and the piston upper chamber in the cylinder 3 are brought into fluid communication with each other. Thus, because of the pressure imparted to the lower outer peripheral surface 52 as well as to the lower end surface 53 of the main valve 19, the main valve 19 moves rapidly toward the top dead center, and comes into contact with the exhaust rubber 30 to close the air discharge passage 29 whereupon the piston upper chamber is shut off from the atmosphere. In this case, the accumulator 2 is also shut off from the atmosphere.

By the movement of the main valve 19 toward its upper dead center, the fluid in the main valve chamber 8 is discharged into the main valve control channel 40. As described above, the value obtained from dividing the maximum volume V1 of the main valve chamber 8 by the cross-sectional area S1 of the main valve control channel 40 is V1/S1=0.8. This value is set smaller than that in the conventional fastener driving tools. This is a design concept which, just as with the design concept described above, was also obtained as a result of recognition of the flow principle that, with fastener driving tools which have valve chambers, the time period required for the pressure in these valve chambers to drop to a specific pressure due to the discharge of air decreases in accordance with an increase in cross-sectional area of the channels used to discharge air with respect to the volume of these valve chambers.

Figure 9:
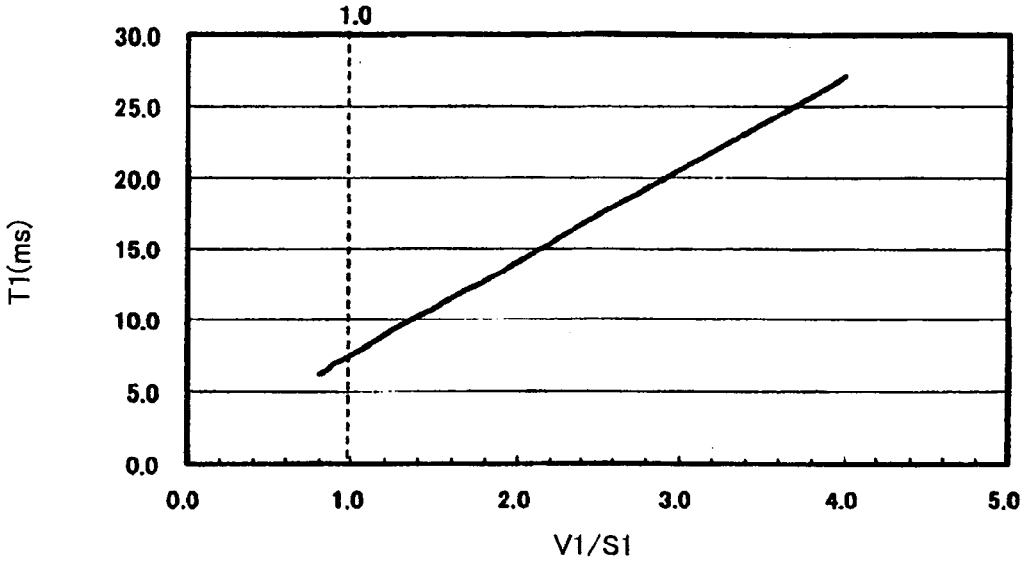
FIG. 9 is a graph showing the relationship between a main valve displacement time (T1) and a ratio of volume (V1) of main valve chamber to a cross-sectional area (S1) of a main valve control channel in the fastener driving tool according to the first embodiment.

FIG. 9 shows the relationship between V1/S1 and the time period T1 from when the pressure in the main valve chamber 8 begins to drop until the main valve 19 moves to maximum displacement. The smaller V1/S1 is made, the smaller T1 becomes as well. For the value in this first embodiment, V1/S1=0.8 at which T1 is approximately 7.0 ms. Consequently, the time period required for the pressure in the main valve chamber 8 to drop to a specific pressure decreases. Accordingly, the time period from when the plunger 7 is pressed as a result of the trigger 39 and the push lever 42 being operated until the main valve 19 moves to maximum displacement can be reduced. As a result, the time period from when the trigger 39 and the push lever 42 are operated until the nailing motion occurs because of the displacement of the main valve 19 can be reduced. Incidentally, if V1/S1 is set to 1.0, T1 becomes 7.5 ms, which is sufficiently small. If V1/S1 is set to 0.6, T1 can be made even smaller, about 5.0 ms. Thus, time period until the nailing motion occurs can be further shortened.

In the first embodiment, a bending section is provided in the main valve control channel 40. However, the bending section does not cause significant flow path resistance, since the bending section is configured into an gentle arcuate shape. Consequently, there is no obstruction in the flow of air in the main valve control channel 40. Furthermore, as described above, the air in the main valve chamber 8 passes from the main valve control channel 40 through air channel 22 of the trigger valve 6 and is discharged into the atmosphere. In this case, since cross-sectional area of the air channel 22 is larger than that of the main valve control channel 40 in terms of air flowing passage, the air channel 22 does not prevent the air from flowing from the main valve chamber 8 into the atmosphere. Consequently, the time period from when the trigger 39 and the push lever are operated until the nailing motion occurs can be shortened.

Thus, by setting the maximum volume of the main valve chamber 8 and the cross-sectional area of the main valve control channel 40 to the aforementioned values, the compressed air in the main valve chamber 8 will escape more quickly, so that the time period until the main valve chamber 8 assumes the atmospheric pressure can be reduced. Furthermore, a so-called air damper in the main valve chamber 8 is not readily formed because of the improvement on the shape of the main valve control channel 40 and improvement on passing of air through the air channel 22. Accordingly, the escape of air from the main valve chamber 8 can be improved even when the main valve 19 rises to the top dead center. Consequently, the main valve 19 can be moved immediately from the bottom dead center to the top dead center.

By the movement of the main valve 19 from its bottom dead center to the top dead center, the compressed air rapidly flows from the accumulator 2 into the piston upper chamber, thereby rapidly moving the piston 4*a* toward its bottom dead center. Thus, the fastener 5 is driven by the tip end 4*c* of the driver blade 4*b* connected to the piston 4*a*. The air in the underside of the piston 4*a* in the cylinder 3 flows through air channel 36 into the return air chamber 33. Further, a portion of the compressed air in the piston upper chamber also flows through the air channel 35 into the return air chamber 33, after the piston 4*a* is moved past the air channel 35.

Figure 11:
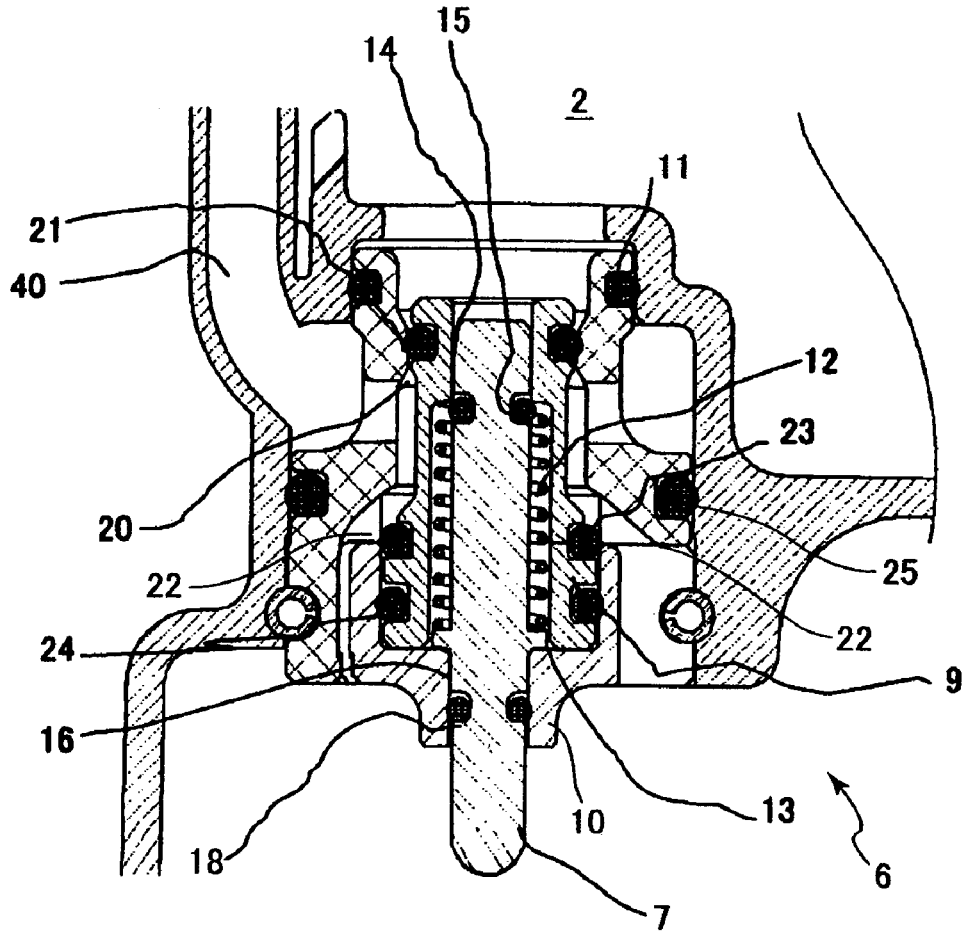
FIG. 11 is an enlarged cross-sectional view particularly showing the trigger valve in the fastener driving tool according to the first embodiment, with the valve piston having moved to the bottom dead center and the plunger then having returned to its original position.

FIG. 11 shows the state where the plunger 7 has just returned to the bottom dead center after release of the trigger 39 or after the pressing of the push lever 42 against the workpiece is stopped. The plunger 7 has moved to the bottom dead center because of the pressure applied to the upper end face of the plunger 7 from the accumulator 2 and the biasing force of the spring 12.

By the movement of the plunger 7 to the bottom dead center, the trigger valve control channel 16 is closed by the O-ring 18, while the O-ring 15 loses its sealing effect. Thus, the compressed air in the accumulator 2 flows through the trigger valve intake channel 14 into the trigger valve chamber 13.

In this case, as described above, the cross-sectional area St of the trigger valve intake channel 14 is set to $2.75\times10^{-6}$ ($m^2$), which is relatively larger than that of the conventional tool. This is due to a design concept obtained as a result of recognition of the tube flow principle that there is a proportional relationship between the mass rate of flow and the cross-sectional area of the tube. More specifically, it is based on the discovery that, with fastener driving tools having valve chambers, the time period required for the pressure in these valve chambers to be increased to a specific pressure due to introduction of the compressed air thereinto is reduced in accordance with an increase in the cross-sectional area of the channels used for the introduction of the compressed air with respect to the volume of these valve chambers.

Figure 7:
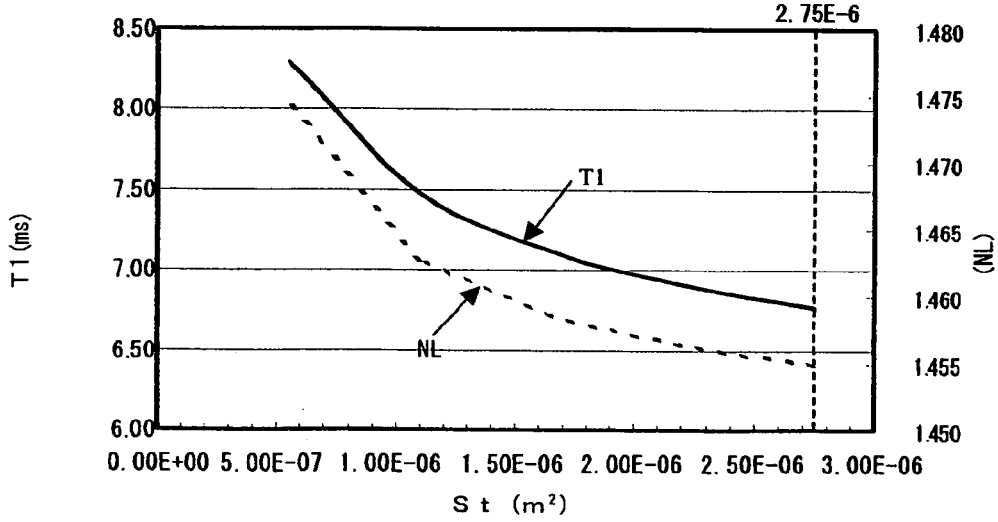
FIG. 7 is a graph showing the relationship between a time period (T1) until a main valve returns to its initial position after a plunger returns to its initial position and a cross-sectional area (St) of a trigger valve intake channel in the fastener driving tool according to the first embodiment.

FIG. 7 shows the relationship (solid line curve) between the cross-sectional area (St) of the trigger valve intake channel 14, and the time period T1 until the main valve returns to the initial position. FIG. 7 also shows the relationship (broken line curve) between the cross-sectional area (St) and air consumption volume NL. As the cross-sectional area St decreases, the main valve return time period can be reduced and the air consumption volume can be decreased. These curves T1 and NL appear as convex functions toward the lower direction. Therefore, the reducing or decreasing effects are not greatly exhibited at the greater range of the cross-sectional area. Taking the phenomena into consideration, the specific value was determined experimentally to be $2.75\times10^{-6}$ ($m^2$). As a result, the time period required for the pressure in the trigger valve chamber 13 to rise to a specific pressure due to the inflow of compressed air is reduced. Thus, the time period from when the pressing force on the plunger 7 ceases until the valve piston 9 returns to the pre-nailing position can be shortened.

By the introduction of the compressed air into the trigger valve chamber 13, the valve piston 9 is moved to its top dead center. Thus, the O-ring 23 blocks fluid communication between the air channel 22 and the main valve control channel 40, while the O-ring 21 loses its sealing effect so that the accumulator 2 is fluidly connected to the main valve chamber 8 via the main valve intake channel 20 and the main valve control channel 40. Thus, compressed air flows from the accumulator 2 into the main valve chamber 8.

As described above, the value obtained from dividing the maximum volume V1 of the main valve chamber 8 by the cross-sectional area S1 of the main valve control channel 40 is V1/S1=0.8. This value is set smaller than that of the conventional fastener driving tools. As with the design concept for the trigger valve intake channel 14, this value is determined based on the design concept that, with fastener driving tools having valve chambers, the time period required for the pressure in these valve chambers to be increased to a specific pressure by the introduction of the compressed air thereinto is reduced in accordance with an increase in the cross-sectional area of the channels used for the introduction of the compressed air with respect to the volume of these valve chambers.

Figure 10:
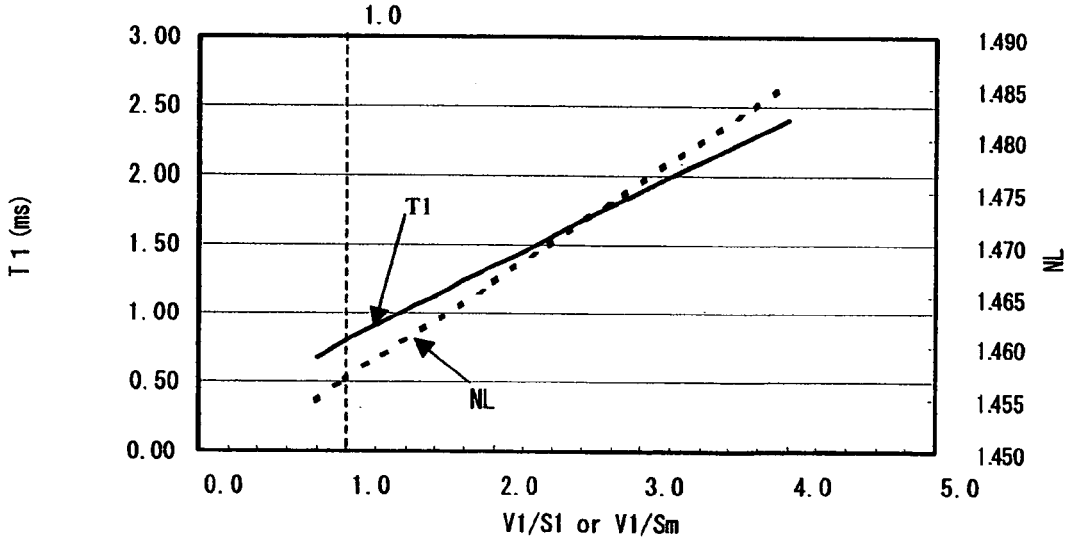
FIG. 10 is a graph in which a solid line curves shows the relationship between the main valve displacement time (T1) and the ratio of volume (V1) of main valve chamber to the cross-sectional area (S1) of the main valve control channel, and a broken line curves shows the relationship between air consumption amount (NL) and the ratio (V1/S1) or (V1/Sm) in which "Sm" designates a main intake control channel according to the first embodiment.

FIG. 10 shows the relationship between V1/S1, and the time period T1 until the main valve 19 returns to the initial position (lower dead position). FIG. 10 also shows the relationship between V1/S1 and the air consumption volume NL. The lower V1/S1 becomes, the lower T1 becomes as well. For the value in this first embodiment, V1/S1 is set to 0.8 at which T1 is approximately 7.0 ms. Consequently, the time period required for the pressure in the main valve chamber 8 to rise to a specific pressure by the introduction of compressed air thereinto can be reduced. Thus, the time period from when the valve piston 9 begins to return to the pre-nailing position (toward the top dead center) until the main valve 19 closes the main valve rubber 27 can be reduced. As a result, the time period to the restoration timing for the subsequent nail driving operation after the actual nail driving operation can be reduced. More specifically, the time period from when the trigger 39 and the push lever 42 are operated until the main valve reaches its bottom dead center as a result of the movement of the valve piston 9 to the pre-nailing position can be reduced. Further, since the time period for the main valve 19 to be closed is reduced, the amount of compressed air flowing from the accumulator 2 to the piston upper chamber can be reduced during movement of the main valve 19 toward its bottom dead center. Incidentally, even if V1/S1 is set to 1.0, T1 will be approximately 7.5 ms, which is sufficiently small in comparison to the conventional examples. If V1/S1 is set to 0.6, T1 can be made even smaller, approximately 5.5 ms. Consequently, the time period, following nailing, for the return to the pre-nailing state can be further reduced, while the amount of compressed air which flows from the accumulator 2 to the piston upper chamber can be further decreased.

In addition, the value obtained from dividing the maximum volume V1 of the main valve chamber 8 by the cross-sectional area Sm of the main valve intake channel 20 is likewise set to V1/S1=0.8. The main valve intake channel 20 and the main valve control channel 40 become a contiguous inflow passage directing to the main valve chamber 8. In this connection, the main valve intake channel 20 should provide a performance at least equal to that of the main valve control channel 40. As a result, V1/Sm was also set to 1.0 or less. In addition, V1/S1 and V1/Sm need not be the same value provided that they are both 1.0 or less. Incidentally, there is the curved area at the main valve control channel 40. However, the curved area does not lead to a significant flow resistance because of the gentle arcuate shape in the curved area. Thus, there is no obstruction in the flow of air to be directed into the main valve chamber 8.

As a result, the compressed air can instantaneously flow into the main valve chamber 8 so that a downward pressing force arises because of the difference in pressure receiving areas among the lower outer peripheral surface 52, the lower end surface 53, and the top end surface 54 of the main valve 19. In this first embodiment, by setting both V1/S1 and V1/Sm to 0.8, the time period required for the main valve 19 to move to the bottom dead center, that is, to return the main valve 19 to its pre-nailing position can be reduced to approximately 3.8 ms. This returning movement is also due to the pressing force arising from the compressed air flowing into the main valve chamber 8 and the biasing force of the main valve spring 28.

Upon movement of the main valve 19 to its bottom dead center, the main valve 19 is coming into contact with the main valve rubber 27 to shut off fluid connection between the accumulator 2 and the piston upper chamber. Further, immediately before the main valve 19 reaches its bottom dead center, the main valve 19 is separated from the exhaust rubber 30 for providing fluid communication from the piston upper chamber with the atmosphere. As a result of the structural relationships, the main valve 19 is separated from the exhaust rubber 30 prior to the complete return of the main valve 19 to the bottom dead center. In this instance, since the accumulator 2 and the piston upper chamber are not yet completely blocked from each other, the accumulator 2 is connected to the atmosphere through the piston upper chamber and the air discharge passage 29, so that the compressed air is discharged unnecessarily into the atmosphere. However, by setting VI/S1 and V1/Sm to 1.0 or less, and also setting the cross-sectional area St of the trigger valve intake channel 14 to $2.75\times0^{-6}$ ($m^2$), the time period for the main valve 19 to move to the bottom dead center can be shortened, so that the unwanted consumption of the compressed air due to leakage of compressed air from the accumulator 2 to the atmosphere can be reduced as is apparent from FIG. 10.

Then, underside of the piston 4*a* is then pressed by the compressed air accumulated in the return air chamber 33, and the piston 4*a* rapidly moves to its top dead center. The air in the piston upper chamber is released from the exhaust hole 49 to the atmosphere through the air discharge passage 29, and the fastener driving tool 1 returns to the initial state shown in FIG. 1.

Figure 12:
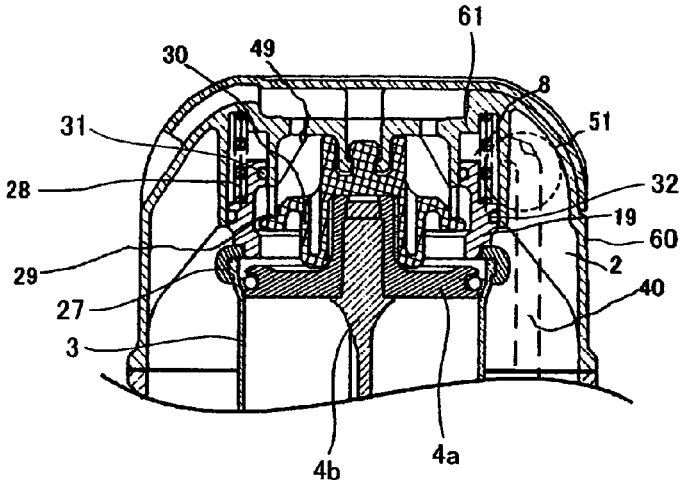
FIG. 12 is a partial cross-sectional view particularly showing a main valve according to a modification to the first embodiment.

FIG. 12 shows a modification to the main valve control channel 40. In the first embodiment shown in FIG. 3, the bending portion (enclosed by the circle 51) of the main valve control channel 40, is configured into the gentle arcuate shape. In the modification shown in FIG. 12, the bending portion can include at least two bent areas. In the latter case, the bending angle is preferably not less than 100°. With this arrangement, air can be smoothly flowed into the main valve chamber 8, and the air in the main valve chamber 8 can be smoothly discharged therefrom, without excessive channel resistance. As an another modification, the cross-sectional area of the trigger valve intake channel 14 can be made large such as $3.00\times10^{-6}$ ($m^2$) or $3.25\times10^{-6}$ ($m^2$). In so doing, the unit rate of flow of the compressed air entering the trigger valve chamber 13 increases, so that the time period required for the pressure increase in the trigger valve chamber 13 can be shortened.

Figure 13:
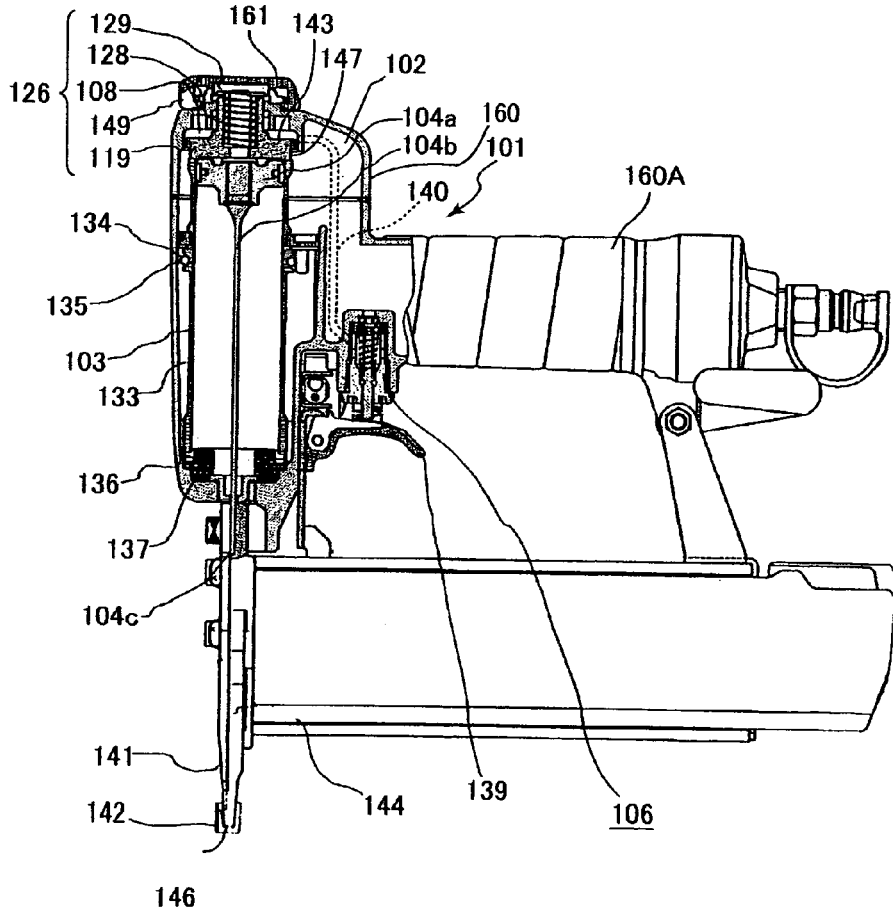
FIG. 13 is a cross-sectional view of the fastener driving tool according to a second embodiment of the present invention.

Next, a fastener driving tool according to a second embodiment of the present invention will be described with reference to FIG. 13 to FIG. 16. The overall structure of the fastener driving tool 101 shown in FIG. 13 is substantially the same as the first embodiment except that the valve piston 9 in the first embodiment is not provided. Consequently, a detailed description will be omitted. In FIGS. 13 through 16, like parts and components are designated by reference numerals added with 100 to the reference numerals shown in FIGS. 1 through 11.

A nail gun 101 includes a frame 160, a handle 160A, a nose 141 having an injection opening 146, an accumulator 102, a cylinder 103, a piston 104*a*, a driver blade 104*b* and its tip end 104*c*, a return air chamber 133, one way valve 134, air channels 135, 136, a piston bumper 137, a trigger 139, a trigger valve 106 including a plunger 107, a push lever 142, a magazine 144, and a main valve 126.

Figure 14:
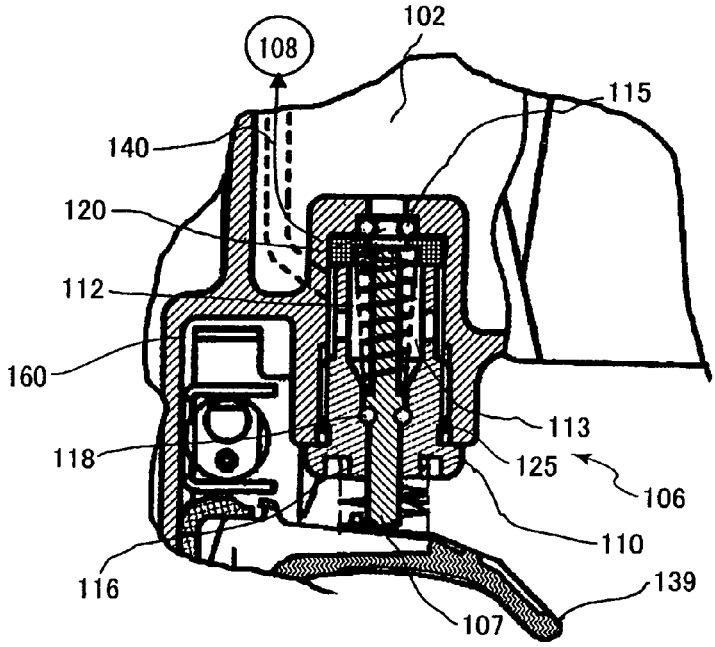
FIG. 14 is an enlarged cross-sectional view particularly showing a trigger valve in the fastener driving tool according to the second embodiment.

The trigger valve 106 shown in FIGS. 13 and 14 mainly includes a valve bush 110, a plunger 107, and a spring 112. The valve bush 110 formed with a through hole is fixed to the frame 160 to form a trigger valve exterior frame which constitutes an outer wall of the trigger valve 106. The plunger 107 is provided reciprocably slidably with respect to the through hole of the valve bush 110. The plunger 9 has a bottom end in contact with the trigger 139. The spring 112 is interposed between the frame 160 and the plunger 107 for biasing the plunger 107 downward.

The trigger valve 106 is fluidly connected to a cylindrical main valve control channel 140 extending from a main valve chamber 108. Specifically, the main valve control channel 140 is configured such that its cross-sectional area S1 is $3.2\times10^{-5}$ ($m^2$).

In addition, an O-rings 125 is fitted on the valve bush 110 for continually blocking fluid connection between the main valve control channel 140 and an atmosphere. A trigger valve chamber 113 is defined by the frame 160 and the valve bush 110 secured to the frame 160.

The plunger 107 extends through the trigger valve chamber 113, and has an upper portion extending through a through-hole formed in the frame 160. An annular space is defined between the through-hole and the plunger 107 for serving as a main valve intake channel 120. The main valve intake channel 120 has a cross-sectional area Sm of $3.2\times10^{-5}$ ($m^2$). The cross-section extends in a direction perpendicular to the flowing direction. An O-ring 115 is fitted at the through-hole of the frame 160 for shutting off the main valve intake channel 120 when the plunger 107 is moved to its top dead center.

The plunger 107 has a lower section associated with the through hole of the valve bush 110. The lower section has an outer diameter slightly smaller than an inner diameter of the through hole of the valve bush 110 for defining an air channel 116 therebetween. This air channel 116 has a cross-sectional area of at least $3.2\times0^{-5}$ ($m^2$). An O-ring 118 is fitted onto the lower section of the valve bush 110 for closing the air channel 116 when the plunger 107 is moved to the bottom dead center. The main valve intake channel 120 and air channel 116 are alternately blocked in accordance with the sliding motion of the plunger 107.

The main valve 126 is provided at an upper end and around an outer peripheral surface of the cylinder 103 as shown in FIG. 13. The main valve 126 includes a main valve 119 and a main valve spring 128 for biasing the main valve 119 toward its bottom dead center. An discharge passage 129 is formed above the main valve 119, and an exhaust port 149 in communication with the discharge passage 129 is formed at an upper portion of the frame 160.

A main valve sectioning region 161 is provided as a part of the frame 160 for defining a main valve chamber 108 in which the main valve 119 is vertically movably disposed. The main valve chamber 108 is in communication with the main valve control channel 140.

The main valve chamber 108 is hermetically provided by O-rings (not shown). The main valve chamber 8 has an internal volume variable in accordance with the vertical movement of the main valve 119, but has a maximum volume V1 of $2.56\times10^{-5}$ ($m^3$). As a result, the value obtained from dividing the volume V1 by the cross-sectional area S1 of the main valve control channel 40 is V1/S1=0.8≦1.0. Likewise, the value obtained from dividing the volume V1 by the cross-sectional area Sm of the main valve intake channel 120 is V1/Sm=0.8≦1.0. In addition, the main valve control channel 140 has a curving portion. The curving portion is formed into a gentle arcuate shape.

The nail driving operation will be described. FIGS. 13 and 14 show a state in which compressed air from the compressor (not shown) is accumulated in the accumulator 102 through the hose (not shown). In this state, as shown in FIG. 14, the plunger 107 is positioned at its bottom dead center by the biasing force of the spring 112. Since the plunger 107 is positioned at the bottom dead center, the main valve intake channel 120 is open to provide fluid communication between the accumulator 102 and the trigger valve chamber 113. At the same time, the air channel 116 is closed by the O-ring 118, so the fluid connection between the trigger valve chamber 113 and the atmosphere is blocked.

As shown in FIG. 14, since the trigger valve chamber 113 is in communication with the main valve control channel 140, a portion of the compressed air in an accumulator 102 also flows into the main valve control channel 140. Therefore, compressed air is accumulated in the main valve chamber 108 at the same pressure as in the accumulator 102.

Since the part of the compressed air in the accumulator 102 flows into the main valve chamber 108, the main valve 119 is positioned at its bottom dead center as shown in FIG. 13 as a result of downward pressing load arising from the difference in pressure receiving areas between a lower peripheral surface 142 and an upper end surface 143 of the main valve 119, along with the biasing force of the main valve spring 128.

Since the main valve 119 is positioned at the bottom dead center, the main valve 119 comes into contact with an upper end of the cylinder 103 to block fluid communication between the accumulator 102 and the piston upper space in the cylinder 103. In this case, the main valve 110 is separated from the frame 160 to open the air discharge passage 129. As a result, the piston upper chamber of the cylinder 103 is brought into communication with the atmosphere through the air discharge passage 129. Thus, the piston upper chamber assumes the atmospheric pressure. In addition, since the fluid connection between the piston upper chamber and the accumulator 102 is blocked, compressed air in the accumulator 102 does not flow into the piston upper chamber. As a result, the piston 104*a* is maintained at its top dead center position.

Figure 15:
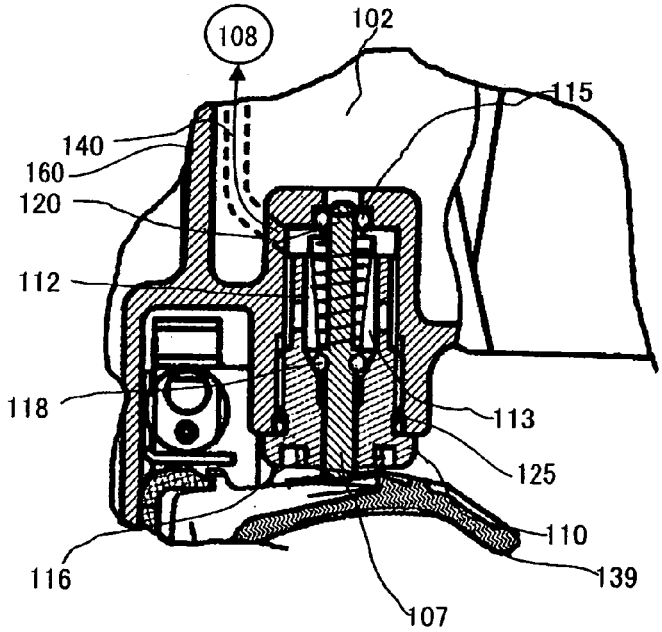
FIG. 15 is an enlarged cross-sectional view particularly showing the trigger valve in the fastener driving tool according to the first embodiment, with a plunger having been pushed upward.
Figure 16:
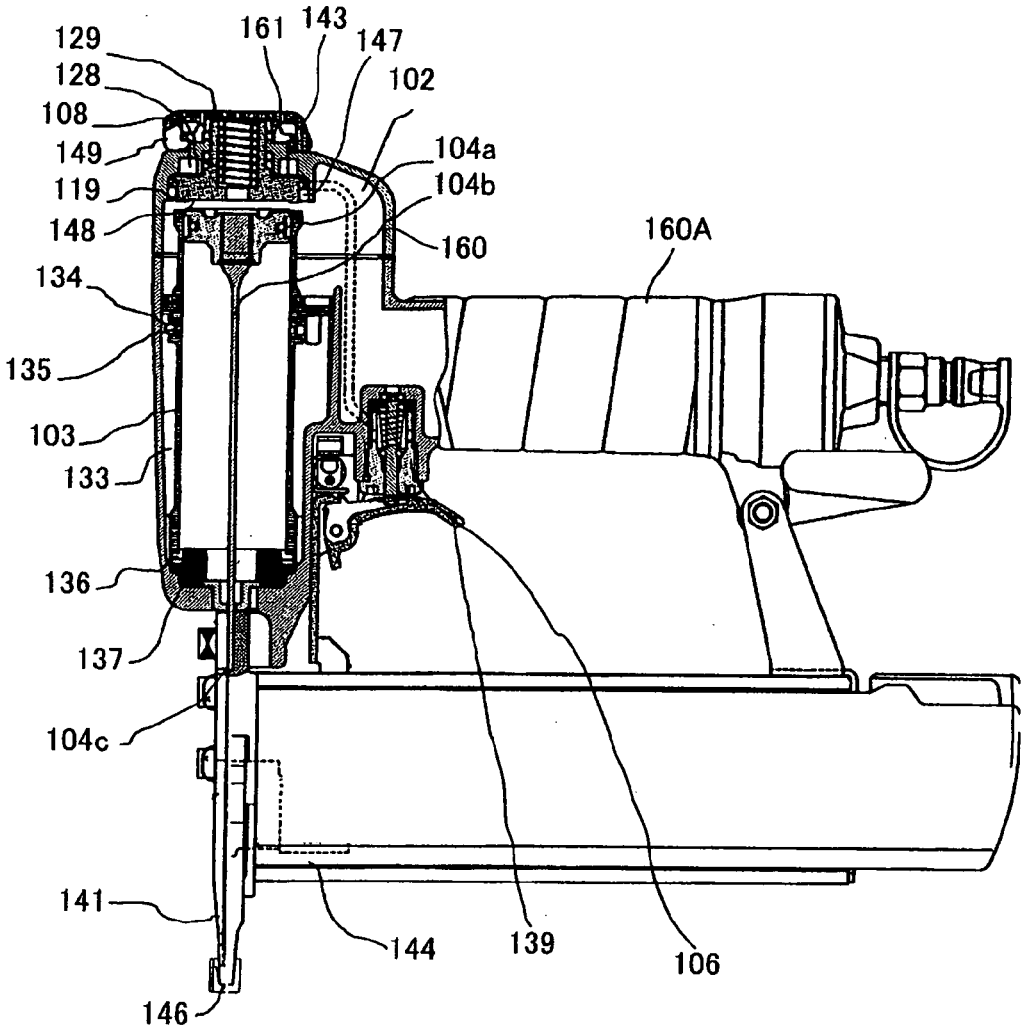
FIG. 16 is a cross-sectional view of the fastener driving tool according to the second embodiment, with a main valve having moved to the top dead center.

FIGS. 15 and 16 show the state where the plunger 107 is pushed up to the top dead center by pulling the trigger 139 and pressing the push lever 142 against the workpiece. Since the upper portion of the plunger 107 extends through the O-ring 115, the fluid connection between the trigger valve chamber 113 and the accumulator 102 is blocked. In addition, the O-ring 118 loses its sealing effect to open the trigger valve control channel 116. As a result, the trigger valve chamber 113 and the atmosphere are fluidly connected to each other, so the inside of the trigger valve chamber 113 assumes the atmospheric pressure. The cross-sectional area of the air channel 116 is greater than that of the main valve channel 140. Thus, the channel resistance in air channel 116 is smaller than that in the main valve channel 140. The main valve control channel 140 connected to the trigger valve chamber 113 is also connected to the atmosphere, and in addition, the main valve chamber 108 connected to the main valve control channel 140 is also connected to the atmosphere and assumes the atmosphere pressure.

When the main valve chamber 108 assumes roughly the atmospheric pressure, the main valve 119 moves to its top dead center as shown in FIG. 16 because compressed air pressure is applied to the lower outer peripheral surface 147 of the main valve 119 whereas the atmospheric pressure is applied to the upper end face 143 of the main valve. When the main valve 119 begins to move toward the top dead center, the accumulator 102 and a piston upper chamber in the cylinder 103 are brought into communication with each other, so that compressed air pressure is also applied to the lower end face 148 of the main valve 119. Thus, the main valve 119 moves rapidly toward the top dead center. As a result, the top end face of the main valve 119 comes into contact with the frame 160 to close the exhaust hole 149, so that fluid communication between the piston upper chamber and the atmosphere is blocked.

In the second embodiment, similar to the first embodiment, the value obtained from dividing the maximum volume V1 of the main valve chamber 108 by the cross-sectional area S1 of the main valve control channel 140 is V1/S1=0.8. This is a design concept which, just as with the design concept in the first embodiment, was obtained as a result of recognition of the flow principle that, with fastener driving tools having valve chambers, the time period required for the pressure in these valve chambers to drop to a specific pressure due to the discharge of air can be reduced in accordance with an increase in cross-sectional area of the channels used to discharge air with respect to the volume of these valve chambers.

The relationship between V1/S1 and the time period T1 from when the pressure in the main valve chamber 108 begins to drop until the main valve 119 moves to maximum displacement is basically the same as that shown in FIG. 9. For the value in this second embodiment, if V1/S1 is 0.8, T1 is approximately 7.0 ms. Further, even if V1/S1 is set to 1.0, T1 will be approximately 7.5 ms, which is sufficiently small in comparison with the conventional tools. With a fastener driving tool which is at least equipped with the main valve 119, the time period required for the pressure in the main valve chamber 108 to drop to a specific pressure due to the discharge of air can be reduced. Accordingly, the time period from when the trigger 139 and the push lever 142 are operated until the nailing motion occurs because of the displacement of the main valve 119 can be reduced. Incidentally, if V1/S1 is set to 0.6, T1 can be made even smaller, about 5.0 ms. Thus, time period until the nailing motion occurs can be further shortened. These values for T1 are sufficiently smaller than those in conventional fastener driving tools.

The air in the main valve chamber 108 passes through the main valve control channel 140 and through the air channel 116 of the trigger valve 106 and is discharged into the atmosphere. In this case, since cross-sectional area of the air channel 116 is larger than that of the main valve control channel 140, the air channel 116 does not prevent the air from flowing from the main valve chamber 108 into the atmosphere. Consequently, the time period from when the trigger 139 and the push lever are operated until the main valve 119 is moved to the top dead center can be shortened.

Thus, by setting the maximum volume of the main valve chamber 108 and the cross-sectional area of the main valve control channel 140 to the aforementioned values, the compressed air in the main valve chamber 108 can be discharged quickly, so that the time period until the main valve chamber 108 assumes the atmospheric pressure can be reduced. Furthermore, a so-called air damper in the main valve chamber 108 is not readily formed because of the improvement on the shape of the main valve control channel 140 and improvement on passing of air through the air channel 116. Accordingly, the discharge of air from the main valve chamber 108 can be improved even when the main valve 119 rises to the top dead center. Consequently, the main valve 119 can be moved immediately from the bottom dead center to the top dead center.

By the movement of the main valve 119 from its bottom dead center to the top dead center, the compressed air rapidly flows from the accumulator 102 into the piston upper chamber, thereby rapidly moving the piston 104*a* toward its bottom dead center. Thus, the fastener is driven by the tip end 104*c* of the driver blade 104*b* connected to the piston 104*a*. The air in the underside of the piston 104*a* in the cylinder 103 flows through air channel 136 into the return air chamber 133. Further, a portion of the compressed air in the piston upper chamber also flows through the air channel 135 into the return air chamber 133, after the piston 104*a* is moved past the air channel 135.

When the trigger 139 is returned or the pressing of the push lever 142 against the workpiece is stopped, the plunger 107 moves to the bottom dead center because of the pressure applied to the plunger 107 from the accumulator 102 and the biasing force of the spring 112 (FIG. 14).

By the movement of the plunger 107 to the bottom dead center, the air channel 116 is closed by the O-ring 118, while the O-ring 115 loses its sealing effect. Thus, the compressed air in the accumulator 102 flows through the main valve intake channel 120 into the trigger valve chamber 113. In this case, because the trigger valve chamber 113 is in communication with the main valve control channel 140, the main valve chamber 108 is communicated with the accumulator 102 through the main valve intake channel 120. Thus compressed air is introduced into the main valve chamber 108.

As described above, the value obtained from dividing the maximum volume V1 of the main valve chamber 108 by the cross-sectional area S1 of the main valve control channel 140 is V1/S1=0.8. This value is set smaller than that of the conventional fastener driving tools. As with the design concept for the trigger valve intake channel 14, this value is determined based on the design concept that, with fastener driving tools having valve chambers, the time period required for the pressure in these valve chambers to be increased to a specific pressure by the introduction of the compressed air thereinto is reduced in accordance with an increase in the cross-sectional area of the channels used for the introduction of the compressed air with respect to the volume of these valve chambers.

The graph shown in FIG. 10 is also available in the second embodiment. The lower V1/S1 becomes, the lower T1 becomes as well. Since V1/S1 is set to 0.8, T1 is approximately 7.0 ms. Consequently, the time period required for the pressure in the main valve chamber 108 to rise to a specific pressure by the introduction of compressed air thereinto can be reduced. Thus, the time period from when the main valve 119 begins to return to the pre-nailing position (toward the bottom dead center) until the main valve 119 closes the top end of the cylinder 103 can be reduced. As a result, the time period from when the trigger 139 and the push lever 142 are operated until the main valve 119 reaches its bottom dead center (until the pre-nailing state for the subsequent nail driving operation) can be reduced. Further, since the time period for the main valve 119 to be closed is reduced, the amount of compressed air flowing from the accumulator 102 to the piston upper chamber can be reduced during movement of the main valve 119 toward its bottom dead center. Incidentally, even if V1/S1 is set to 1.0, T1 will be approximately 7.5 ms, which is sufficiently small in comparison to the conventional tools. If V1/S1 is set to 0.6, T1 can be made even smaller, approximately 5.5 ms. Consequently, the time period, following nailing, for the return to the pre-nailing state can be further reduced, while the amount of compressed air which flows from the accumulator 102 to the piston upper chamber can be further decreased.

In addition, the value obtained from dividing the maximum volume V1 of the main valve chamber 108 by the cross-sectional area Sm of the main valve intake channel 120 is likewise set to V1/S1=0.8. The main valve intake channel 120 and the main valve control channel 140 become a contiguous inflow passage directing to the main valve chamber 108. In this connection, the main valve intake channel 120 should provide a performance at least equal to that of the main valve control channel 140. As a result, V1/Sm was also set to 1.0 or less. In addition, V1/S1 and V1/Sm need not be the same value provided that they are both 1.0 or less. Incidentally, there is the curved area at the main valve control channel 140. However, the curved area does not lead to a significant flow resistance because of the gentle arcuate shape in the curved area. Thus, there is no obstruction in the flow of air to be directed into the main valve chamber 108.

As a result, the compressed air can instantaneously flow into the main valve chamber 108 so that a downward pressing force is imparted on the main valve 108 because of the difference in pressure receiving areas between the lower outer peripheral surface 147 and the top end surface 143 of the main valve 119. In the second embodiment, by setting both V1/S1 and V1/Sm to 0.8, the time period required for the main valve 119 to move to the bottom dead center, that is, to return the main valve 119 to its pre-nailing position can be reduced to approximately 3.8 ms. This returning movement is also due to the pressing force arising from the compressed air flowing into the main valve chamber 108 and the biasing force of the main valve spring 128.

Upon movement of the main valve 119 to its bottom dead center, the main valve 119 is coming into contact with the upper end of the cylinder 103 to shut off fluid connection between the accumulator 102 and the piston upper chamber.

Further, immediately before the main valve 119 reaches its bottom dead center, the main valve 119 is separated from the frame 160 for providing fluid communication from the piston upper chamber with the atmosphere. As a result of the structural relationships, the main valve 119 is separated from the frame 160 prior to the complete return of the main valve 119 to the bottom dead center. In this instance, since the accumulator 102 and the piston upper chamber are not yet completely blocked from each other, the accumulator 102 is connected to the atmosphere through the piston upper chamber and the air discharge passage 129, so that the compressed air is discharged unnecessarily into the atmosphere. However, by setting V1/S1 and V1/Sm to 1.0 or less, the time period for the main valve 119 to move to the bottom dead center can be shortened, so that the unwanted consumption of the compressed air due to leakage of compressed air from the accumulator 102 to the atmosphere can be reduced as is also apparent from FIG. 10.

Then, underside of the piston 104*a* is then pressed by the compressed air accumulated in the return air chamber 133, and the piston 104*a* rapidly moves to its top dead center. The air in the piston upper chamber is released from the exhaust hole 149 to the atmosphere through the air discharge passage 129, and the fastener driving tool 1 returns to the initial state shown in FIG. 13.

In the second embodiment, the bending portion of the main valve control channel 140 is configured into the gentle arcuate shape. As a modification, the bending portion can include at least two bent areas. In the latter case, the bending angle is preferably not less than 100°. With this arrangement, air can be smoothly flowed into the main valve chamber 108, and the air in the main valve chamber 108 can be smoothly discharged therefrom, without excessive channel resistance. With this arrangement, can be reduced the first time period from operation timing of the trigger 139 and the push lever 142 to the actual driving operation, and the second time period from release timing of the plunger 107 to the timing at which the main valve 119 has returned to its pre-driving position.

Figure 17:
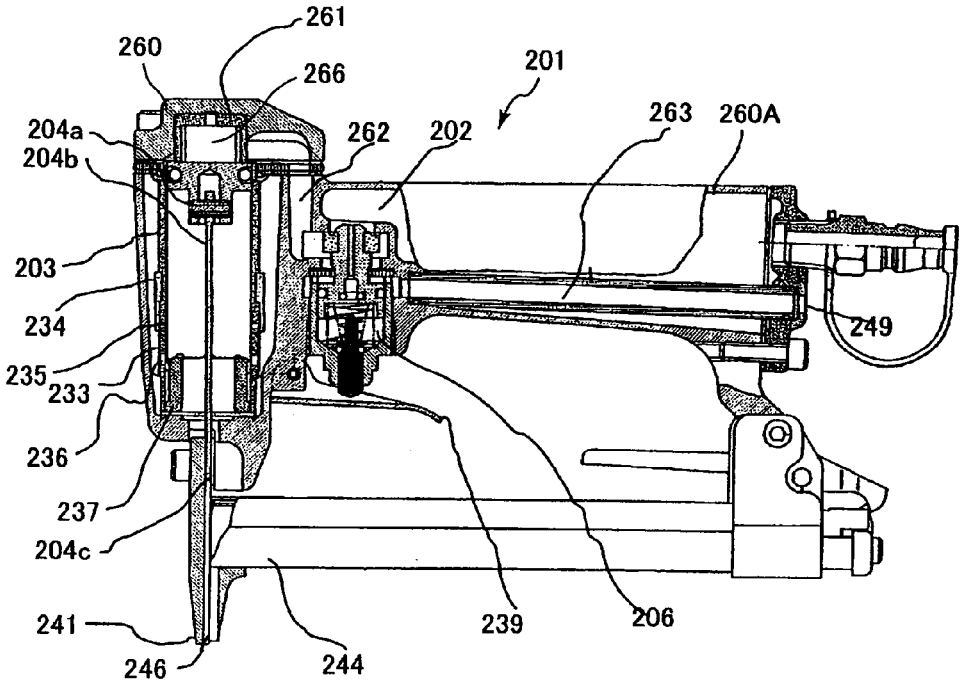
FIG. 17 is a cross-sectional view of a fastener driving tool according to a third embodiment of the present invention.
Figure 18:
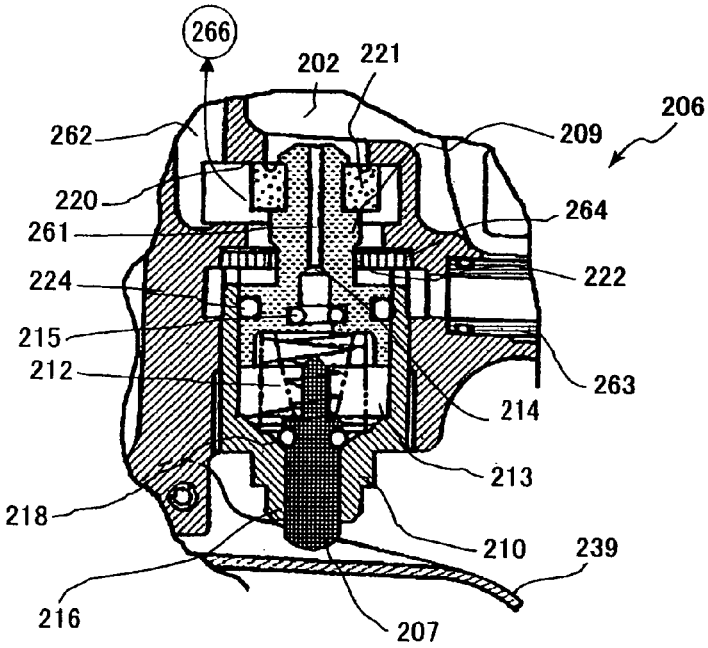
FIG. 18 is an enlarged cross-sectional view particularly showing a trigger valve in the fastener driving tool according to the third embodiment.
Figure 19:
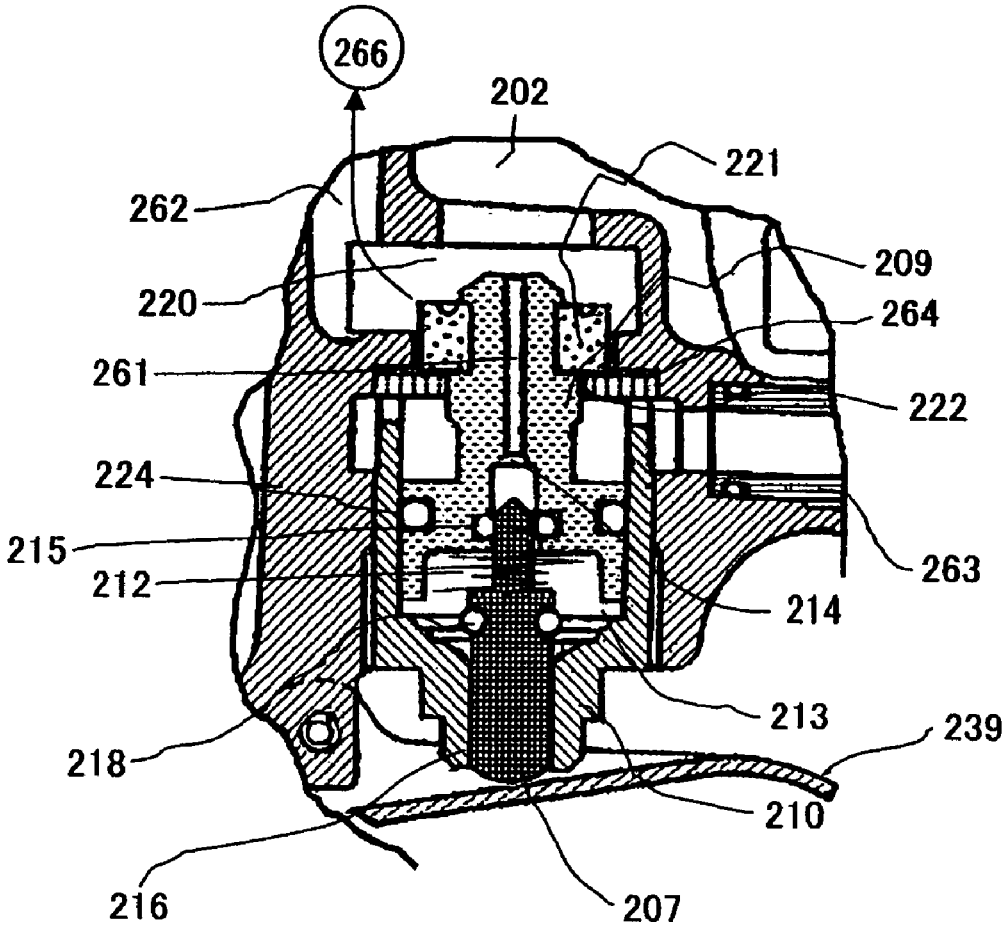
FIG. 19 is an enlarged cross-sectional view particularly showing the trigger valve in the fastener driving tool according to the third embodiment, with a plunger having been pushed upward.

A fastener driving tool according to a third embodiment of the present invention will next be described with reference to FIGS. 17 through 19. The overall structure of the fastener driving tool 201 is substantially the same as the first embodiment except that the main valve section 26 in the first embodiment is not provided. In FIGS. 17 through 19, like parts and components are designated by reference numerals added with 200 to the reference numerals shown in FIGS. 1 through 11.

A nail gun 201 includes a frame 260, a handle 260A, a nose 241 having an injection opening 246, an accumulator 202, a cylinder 203, a piston 204*a*, a driver blade 204*b* and its tip end 204*c*, a return air chamber 233, one way valve 234, air channels 235, 236, a piston bumper 237, a trigger 239, a trigger valve 206 including a plunger 207, and a magazine 244.

A piston upper chamber 266 is defined by the piston 204*a*, the cylinder 203, and the frame 260. The piston upper chamber 266 extends into an upper section of the frame 260. Further, an air channel 262 extends from the piston upper chamber 266 to the trigger valve 206.

The trigger valve 206 shown in FIGS. 17 and 18 mainly includes a valve bush 210, a valve piston 209, the plunger 207, and a spring 212. The valve bush 210 formed with a through hole is fixed to the frame 260 to form a trigger valve exterior frame which constitutes an outer wall of the trigger valve 206. The valve piston 209 is reciprocally slidably disposed in the valve bush 210. The plunger 207 is provided reciprocably slidably with respect to the through hole of the valve bush 210. The plunger 207 has a bottom end in contact with the trigger 239. The spring 212 is interposed between the valve piston 209 and the plunger 207 for biasing the valve piston 209 and the plunger 207 in opposite directions, that is, the valve piston 209 is biased upward, and the plunger 207 is biased downward.

An air channel 262 having a circular cross-section is formed within the frame 260 and extends from the piston upper chamber 266. The air channel 262 is connected to the trigger valve 206. In addition, an exhaust pipe 263 is provided in the handle 206A and has one end serving as an exhaust hole 249 opened at an end face of the handle 260A. The exhaust pipe 263 is connected to the trigger valve 206 at a position below the location at which the air channel 262 is connected to the trigger valve 206. Further, in the trigger valve 206, a valve plate 264 formed with a hole is disposed at a position between the connecting position between the air channel 262 and the trigger valve 206 and the connecting position between the exhaust pipe 263 and the trigger valve 206. The valve piston 209 extends through the hole of the valve plate 264. Further, a space is defined between the hole of the valve plate 264 and the valve piston 209. The space serves as an air channel 222.

Another air channel 220 is formed at the part of the frame 260, the part serving as a part of the trigger valve 206. The air channel 220 is adapted to provide a communication between the accumulator 202 and the trigger valve 206.

One end of the valve piston 209 in the sliding direction faces the accumulator 202. A valve piston rubber 221 is fitted in the vicinity of the opening of air channel 262 and at the upper end portion (a small diameter section) of the valve piston 209. The valve piston rubber 221 is adapted to come into -contact with the frame 260 near the periphery of air channel 220 when the valve piston 209 is at its top dead center (FIG. 18), and come into contact with an area near the periphery of the center hole of the valve plate 264 when the valve piston 209 is at its bottom dead center (FIG. 19). The air channel 222 provides fluid communication between the piston upper chamber 266 and the air channel 262 when the valve piston rubber 221 is released from the valve plate 264 in accordance with the movement of the valve piston 209 to its upper dead center.

The valve piston 209 has a large diameter section provided with an O-ring 224 in sliding contact with the valve bush 210. The O-ring 224 provides sealing at the boundary between the valve piston 209 and the large diameter section.

A trigger valve chamber 213 is defined by one end (lower end) of the large diameter section of the valve piston 209 and the valve bush 210. The trigger valve chamber 213 has an internal volume variable due to the sliding movement of the valve piston 209, and is formed such that a maximum internal volume V2 defined when the valve piston 209 is at the top dead center is $4.0\times10^{-7}$ ($m^3$). The O-ring 224 is adapted for blocking the fluid connection between the air channel 222 and the trigger valve chamber 213.

The plunger 207 extends into the trigger valve chamber 213, and a top end faces the accumulator 2. The small diameter section of the valve piston 209 is formed with a central bore 261 in communication with the accumulator 202, and the large diameter section of the valve piston 209 is formed with a stepped bore in communication with the central bore 261. An O-ring 215 is assembled at the stepped bore.

The plunger 207 has a small diameter section in association with the stepped bore. The outer diameter of the small diameter section of the plunger 207 is smaller than an inner diameter of the stepped bore. The small diameter section of plunger 207 is slidingly engagable with the O-ring 215 (FIG. 19) when the plunger 207 is moved to its top dead center. A trigger valve intake channel 214 is defined by the central bore 261.

The plunger 207 has a large diameter section provided with an O-ring 218 and in association with the through hole of the valve bush 210. An outer diameter of the large diameter section of the plunger 207 is smaller than an inner diameter of the through hole of the valve bush 210 to thus define a trigger valve control channel 216.

Consequently, the trigger valve intake channel 214 provides fluid communication between the accumulator 202 and the trigger valve chamber 213 when the small diameter section of the plunger 207 is disengaged from the O-ring 215. Further, the trigger valve control channel 216 provides fluid communication from the trigger valve chamber 213 to the atmosphere when the O-ring 218 is out of contact from the valve bush 210. The trigger valve intake channel 214 and trigger valve control channel 216 are alternately opened and blocked in accordance with the sliding motion of the plunger 207.

The trigger valve intake channel 214 is formed such that its cross-sectional area St is $2.75\times10^{-6}$ ($m^2$). Further, the trigger valve control channel 216 is formed such that its cross-sectional area S2 is $1.98\times10^{-6}$ ($m^2$). As a result, the value obtained from dividing the maximum volume of the trigger valve chamber 213 by the cross-sectional area of the trigger valve control channel 216 is V2/S2=0.2.

The structure of the trigger valve 206 is such that, when the valve piston 209 is positioned at the top dead center (FIG. 18), the valve piston rubber 221 is in abutment with the frame 260 near the air channel 220. Since the air channel 220 is closed by the valve piston rubber 221, the communication between the accumulator 202 and the piston upper chamber 266 through the air channels 262 and 220 is blocked. Further, the air channel 222 is opened to allow fluid communication between the piston upper chamber 266 and the exhaust pipe 263 through the air channels 262, 220,222. On the other hand, when the valve piston 209 is positioned at the bottom dead center (FIG. 19), the valve piston rubber 221 is seated on the valve plate 264 to close the air channel 222. Thus, fluid communication between the piston upper chamber 266 and the exhaust pipe 263 is shut off. Further, the air channel 220 is opened to provide fluid communication between the accumulator 202 and the piston upper chamber 266 through the air channels 262 and 220.

When the plunger 207 is positioned at the top dead center (FIG. 19), the trigger valve control channel 216 is opened so that the trigger valve chamber 213 is communicated with the atmosphere, while the trigger valve intake channel 214 is closed by the O-ring 215 so that fluid communication between the accumulator 202 and the trigger valve chamber 213 is blocked. On the other hand, when the plunger 207 is positioned at its bottom dead center (FIG. 18), the trigger valve control channel 216 is closed by the O-ring 218, so that fluid communication between the trigger valve chamber 213 and the atmosphere is blocked, while the trigger valve intake channel 214 is opened so that the accumulator 202 and the trigger valve chamber 213 are communicated with each other.

The nail driving operation will be described. FIGS. 17 and 18 show a state in which compressed air from the compressor (not shown) is accumulated in the accumulator 202 through the hose (not shown). In this state, as shown in FIG. 18, the plunger 207 is positioned at its bottom dead center by the biasing force of the spring 212. Since the plunger 207 is positioned at the bottom dead center, the main valve intake channel 214 is open to provide fluid communication between the accumulator 202 and the trigger valve chamber 213. At the same time, the trigger valve control channel 216 is closed by the O-ring 218, so the fluid connection between the trigger valve chamber 213 and the atmosphere is blocked.

In this case, because of the biasing force of the spring 212 and the difference in pressure receiving areas between the lower end area and the upper end area of the valve piston 210, the valve piston 209 is positioned at its top dead center. Therefore, air channel 220 is closed by the valve piston rubber 221 to shut off communication between the accumulator 202 and the air channel 262. At the same time, since the air channel 222 is opened by the valve piston rubber 221, the air channel 262 and the exhaust pipe 263 are fluidly connected to each other. Thus, the piston upper chamber 266 assumes the atmospheric pressure, and the piston 204*a* is positioned at its top dead center as shown in FIG. 17.

FIG. 19 shows the state where the plunger 207 is pushed up to the top dead center by pulling the trigger 239. In this state, the O-ring 218 loses its sealing effect to open the trigger valve control channel 216. As a result, the trigger valve chamber 213 and the atmosphere are fluidly connected to each other, so the trigger valve chamber 213 assumes the atmospheric pressure. Further, since the trigger valve intake channel 214 is closed by the O-ring 215, fluid communication between the accumulator 202 and the trigger valve chamber 213 is blocked.

Since the pressure in the trigger valve chamber 213 becomes atmospheric pressure, pressure difference is provided between the accumulator side and the trigger valve chamber side of the valve piston 209. Thus, the valve piston 209 is moved to its bottom dead center.

The relationship between V2/S2 and the time period T2 from when the pressure in the trigger valve chamber 213 begins to drop until the valve piston 209 moves to maximum displacement is basically the same as that shown in FIG. 6. In the third embodiment, if V2/S2 is 0.2, the time period for the valve piston 209 to move from its top dead center to its bottom dead center is approximately 0.75 ms. With a fastener driving tool which is at least equipped with the valve piston 209, by making the cross-sectional area of the trigger valve used to discharge the air larger with respect to the volume of the trigger valve 213, the time period required for the pressure in the trigger valve chamber 213 to drop to a specific pressure because of the discharge of air can be decreased. Accordingly, the time period from when the plunger 207 is pressed until the valve piston 209 moves to maximum displacement can be shortened. As a result, the time period from when the trigger 239 is operated until the nailing motion occurs due to the displacement of the valve piston 209 can be shortened. Incidentally, if V2/S2 is set to 0.15, T2 can be made even smaller, and if V2/S2 is set to 0.10, T2 can be made smaller still. These values for T2 are sufficiently smaller than those in conventional fastener driving tools.

Thus, by setting the maximum volume V2 of the trigger valve chamber 213 and the cross-sectional area S2 of the trigger valve control channel 216 to the aforementioned values, discharge of the compressed air from the trigger valve chamber 213 can be promptly performed, and the time period until the trigger valve chamber 213 assumes the atmospheric pressure can be reduced. Furthermore, since the discharge of air from the trigger valve chamber 213 can be improved when the valve piston 209 is moved to the bottom dead center, a so-called air damper in which the pressure in the trigger valve chamber 213 impedes the movement of the valve piston 209 is not readily formed. Accordingly, the valve piston 209 can be moved immediately from the top dead center to the bottom dead center without being interrupted by the air damper. Incidentally, even though the valve piston 209 is biased toward the top dead center by the spring 212, the valve piston 209 is movable to the bottom dead center against the biasing force because of the pressure difference since the biasing force of the spring 212 is set beforehand to be weaker than the force caused by the pressure difference.

As shown in FIG. 19, when the valve piston 209 reaches its bottom dead center, the air channel 222 is closed by the valve piston rubber 221 to block fluid communication between the air channel 262 and the exhaust pipe 263. At the same time, the air channel 220 is opened by the valve piston rubber 221, so that the accumulator 202 and air channel 262 are fluidly connected to each other. Thus, air flows from the accumulator 202 into the piston upper chamber 266, and the piston upper chamber 266 provides the pressure level the same as that in the accumulator 202. In this instance, since the pressure in the piston upper chamber 266 becomes greater than the pressure in the piston lower chamber in the cylinder 203, the piston 204*a* moves rapidly to its bottom dead point. Thus, the fastener is driven by the tip end 204*c* of the driver blade 204*b*. The air in the underside of the piston 204*a* in the cylinder 203 flows through an air channel 236 into the return air chamber 233. Further, a portion of the compressed air in the piston upper chamber 266 flows through the air channel 235 into the return air chamber 233, after the piston 204*a* is moved past the air channel 235.

When the trigger 239 is returned, the plunger 207 moves to its bottom dead center because of the pressure applied from the accumulator 202 and the biasing force of the spring 212. In this case, as described above, the cross-sectional area St of the trigger valve intake channel 214 is set to $2.75\times10^{-6}$ ($m^2$), which is relatively larger than that of the conventional tool. This is due to a design concept in that the mass rate of flow is proportional to the cross-sectional area of the tube. That is, it is based on the discovery that, with fastener driving tools having valve chambers, the time period required for the pressure in these valve chambers to be increased to a specific pressure due to introduction of the compressed air thereinto is reduced in accordance with an increase in the cross-sectional area of the channels used for the introduction of the compressed air with respect to the volume of these valve chambers.

At this point, since the cross-sectional area St of the trigger valve intake channel 214 is set to $2.75\times10^{-6}$ ($m^2$), the pressure in the trigger valve chamber 213 instantaneously rises. As a result, the time period required for the pressure in the trigger valve chamber 213 to rise to a specific pressure due to the flow of compressed air can be decreased. Thus, the time period from when the pressing force on the plunger 207 ceases until the valve piston 209 returns to the pre-nailing position can be shortened. The valve piston rubber 221 provided on the valve piston 209 comes into contact with the frame 260 at the top dead center of the valve piston 209, and comes into contact with the valve plate 264 at the bottom dead center of the valve piston 209. Therefore, a fluid connection between the piston upper chamber 266 and the accumulator 202, and a fluid connection between the piston upper chamber 266 and the exhaust pipe 263 is alternately provided.

However, in more detailed aspect, during the movement of the valve piston 209 from its bottom dead center to its top dead center, the valve piston rubber 264 is out of contact from the frame 260 and from the valve plate 264. Accordingly, the connection between the piston upper chamber 266 and the accumulator 202 and the connection between the piston upper chamber 266 and the atmosphere can be simultaneously formed. As a result, the accumulator 202 and the atmosphere are connected, and the compressed air in the accumulator 202 is discharged into the atmosphere even during the movement of the valve piston 209 from its bottom dead center to its top dead center, which results in a waste of compressed air. However, since the valve piston 209 in the third embodiment can move from the bottom dead center to the top dead center more quickly than with the conventional tools, the amount of wasted compressed air which is unnecessarily discharged can be reduced.

At that point, the air channel 220 is closed by the valve piston rubber 221 to block communication between the accumulator 202 and the air channel 262. Thus, the flow of air from the accumulator 202 to the piston upper chamber 266 stops. In addition, air channel 222 is opened, so that air channel 262 and the exhaust pipe 263 are fluidly connected to each other. As a result, the air which has been accumulated in the piston upper chamber 266 is discharged to the atmosphere through the air channel 262, 222, exhaust pipe 263 and the exhaust hole 249. Thus, the piston upper chamber 266 assumes the atmospheric pressure.

Consequently, the piston 204*a* moves rapidly to the top dead point because the bottom of the piston 204*a* is imparted with a pressing force by the compressed air accumulated in the return air chamber 233, and the fastener driving tool 201 returns to the state shown in FIG. 17. Incidentally, the cross-sectional area of the trigger valve intake channel 214 can be made larger such as $3.00\times10^{-6}$ ($m^2$) or $3.25\times10^{-6}$ ($m^2$). With this arrangement, the unit rate of flow of the compressed air entering the trigger valve chamber 213 increases, so that the time period required for the pressure increase in the trigger valve chamber 213 can be shortened.

Characteristic in nailing motion of the fastener driving tool according to the first embodiment will be described chronologically in comparison with a comparative fastener driving tool. In the graph shown in FIG. 20, the characteristics of the process of driving a nail into wood are shown for the fastener driving tool 1 involved in the first embodiment, and in the graph shown in FIG. 21, the characteristics of the process of driving a nail into wood with a fastener driving tool are shown for the comparative fastener driving tool.

Figures 20A, 20B, 20C, 20D:
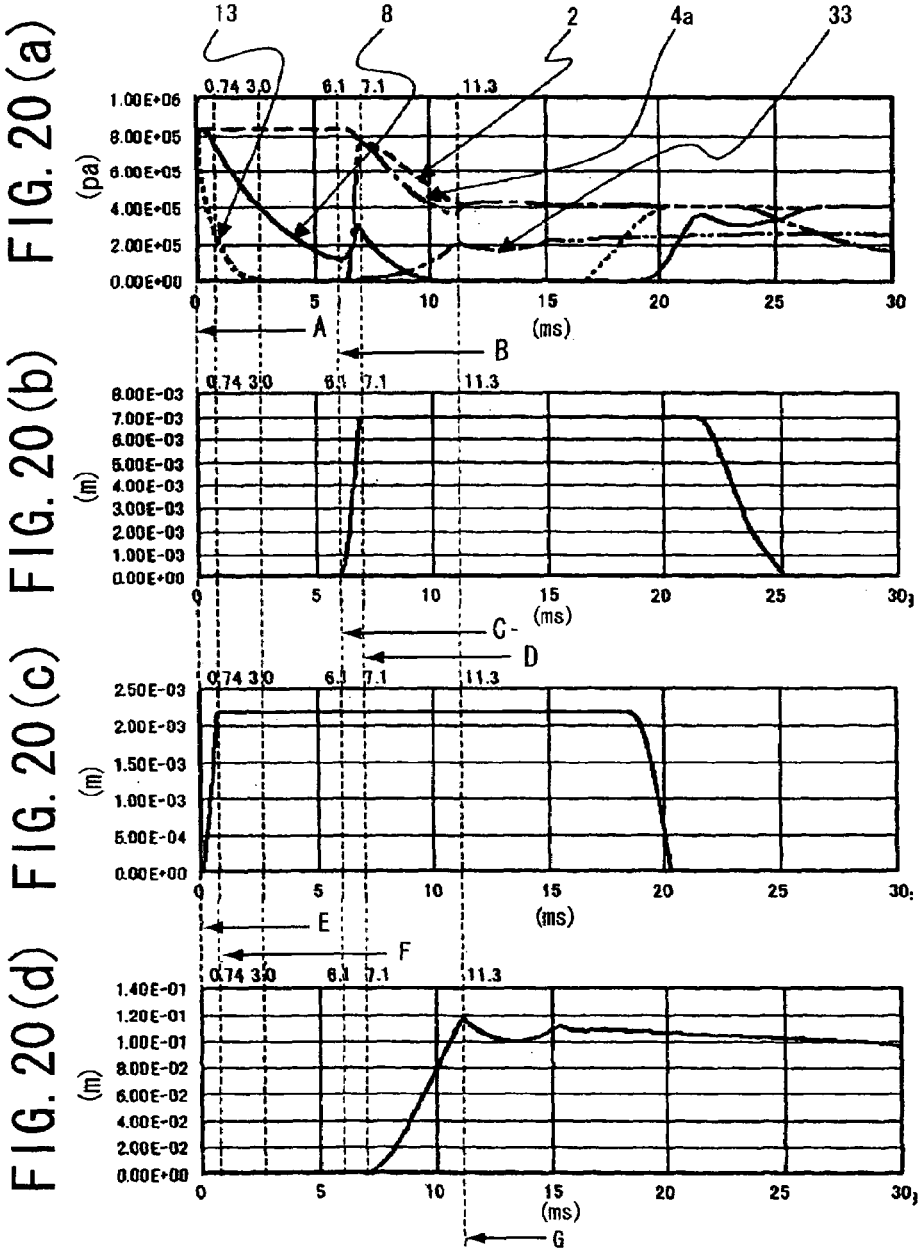
FIG. 20(*a*) is a graph showing the relationship between time and pressure in a trigger valve chamber 13, a main valve chamber 8, an accumulator 2, a piston upper chamber 4*a*, and a return chamber 33 in a fastener driving tool according to the first embodiment.

In these graphs, the x-axis represents time, and y-axis in FIG. 20(*a*) represents pressure in the trigger valve chamber 13, the main valve chamber 8, the accumulator 2, the piston 4*a* upper chamber, and the return chamber 33 in the fastener driving tool according to the first embodiment. Further, Y-axes in FIGS. 20(*b*) through 20(*d*) represent a displacement of the main valve 19, a displacement of the valve piston 9, and a displacement of the piston 4*a* according to the first embodiment. Here, the origin of the x-axis (0 ms) represents the time at which the plunger 7 is pressed and the pressure in the trigger valve chamber 13 begins to drop. The same is true with respect to FIGS. 21(*a*) through (*d*) for the comparative fastener driving tool.

The dimensions in the comparative fastener driving tool involved in the nailing process were: maximum main valve chamber volume V1'=$2.56\times10^{-5}$ ($m^3$); main valve control channel cross-sectional area S1'=$0.8\times10^{-5}$ ($m^2$); V1'/S1'=3.2; maximum trigger valve chamber volume V2'=$4.0\times10^{-7}$ ($m^3$); trigger valve control channel cross-sectional area S2'=$0.465\times10^{-6}$ ($m^2$); V2'/S2'=0.86. The dimensions in the fastener driving tool involved in the first embodiment were:

maximum main valve chamber 8 volume V1=2.56×10$^{-5}$ (m$^3$); main valve control channel 40 cross-sectional area S1=3.2×10$^{5}$ (m$^2$); V1/S1=0.8; maximum trigger valve chamber 13 volume V2=4.0×10$^{-7}$ (m$^3$); trigger valve control channel 16 cross-sectional area S2=1.98×10$^{-6}$ (m$^2$); V2/S2=0.2.

Figure 21:
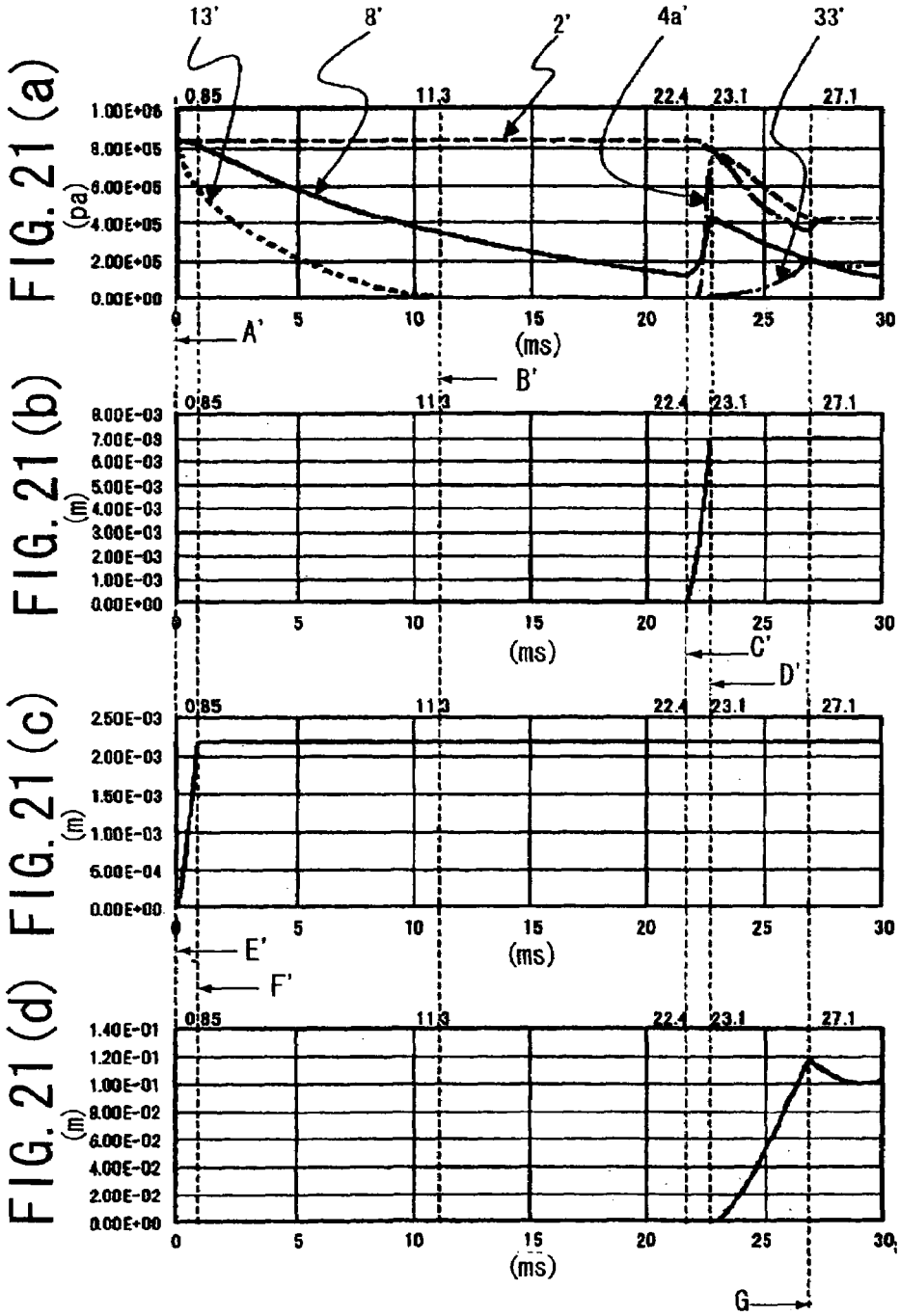
FIG. 21(*a*) is a graph showing the relationship between time and pressure in a trigger valve chamber 13', a main valve chamber 8', an accumulator 2', a piston upper chamber 4*a'*, and a return chamber 33' in a comparative fastener driving tool.

In FIGS. 20 and 21, A and A' represent the timing at which pressure drop in the trigger valve chamber 13 is started, B and B' represent the timing at which the pressure in the trigger valve chamber 13 becomes atmospheric pressure, C and C' represents the timing at which the movement of the main valve 19 toward its upper dead center is started, D and D' represent the timing at which the main valve 19 reaches its top dead center, E and E' represent the timing at which the movement of the valve piston 9 toward its bottom dead center is started, F and F' represent the timing that the valve piston 9 reaches its bottom dead center, and G and G' represent the timing at which the piston 4*a* reaches its bottom dead center.

By pressing the plunger 7, the pressure in the trigger valve chamber 13 drops and, in conjunction with this pressure change, the valve piston 9 begins to be displaced from the top dead center. At that point, since V2/S2=0.2 in the first embodiment has been set smaller than the value V2'/S2'=0.86 in the comparative tool, so the compressed air in the trigger valve chamber 13 can be instantaneously discharged through the trigger valve control channel 16 into the atmosphere. As a result, only 3.0 ms was required for the pressure drop to the atmosphere in the trigger valve chamber 13, whereas 11.3 ms was required for the pressure drop in the comparative tool (see B and B'). Further, only 0.74 ms was required for moving the valve piston 9 to its bottom dead center in the first embodiment whereas 0.85 ms was required for the movement in the comparative tool (see F and F').

Because of the displacement of the valve piston 9 toward its bottom dead center, the O-ring 23 loses its sealing effect, so that the air channel 22 and the main valve control channel 40 are fluidly connected to each other and the pressure in the main valve chamber 8 begins to drop. At that point, since V1/S1=0.8 in the first embodiment is smaller than V1'/S1'=3.2 in the comparative tool, the compressed air in the main valve chamber 8 can be instantaneously discharged through the main valve control channel 40 and the air channel 22 into the atmosphere. As a result, 22.4 ms was required for the pressure drop in the conventional main valve chamber to the minimum value for starting movement of the main valve from its bottom dead center. On the other hand, only 6.1 ms was required for the pressure drop in the main valve chamber 13 to the minimum value for starting movement of the main valve 19 from its bottom dead center (see C and C'). During this period, the pressure in the main valve chamber 8 rises temporarily due to the displacement of the main valve 19. However, since the cross-sectional area of the air channel 22 was set to be smaller than the cross-sectional area of the main valve control channel 40, excessive back-pressure is not applied to the main valve chamber 8. Then, the main valve 19 in the first embodiment reaches the top dead point after 7.1 ms (see D).

By the movement of the main valve 19 toward its top dead center, the compressed air flows from the accumulator 2 to the piston upper chamber, so that the piston upper chamber becomes highly pressurized. Due to the pressure difference between the upper chamber and lower chamber of the piston 4*a*, the piston 4*a* drops to the bottom dead center for driving the fastener 5. As a result of this, the process from when the worker pulls the trigger 39 until the fastener 5 is driven is completed. In the first embodiment, the process only requires 11.3 ms, whereas the comparative tool requires 27.1 ms (see F and F'). This difference clearly represents an improvement on the nailing response.

In addition, as a result of experimentation using a variety of fastener driving tools and investigating what degree of improvement in the response was sufficient for the effect to be perceived, it was found that if nailing occurred within 12 ms after the trigger is pulled and the push lever was pressed against the workpiece, the response was perceived to be good, the work became easy to perform, and it became easy to drive fasteners in a continuous manner. Moreover, it was found that as this amount of time grew longer, the response gradually grew worse, and in the vicinity of the 27.1 ms of the conventional tool, the work became difficult to perform and it became difficult to drive fasteners in a continuous manner. From this perspective as well, the response was improved, and the work performance was improved as well based on the fastener driving tool 1 in the first embodiment.

Next, an entire one-shot process starting from the pushing timing of the plunger 7 to the recovery timing to the initial state for starting the next nail driving operation will be described with reference to FIGS. 22(*a*) through 23(*e*). These graphs are particularly useful for the explanation of the process of returning to the initial state.

Figures 22A, 22B, 22C, 22D, 22E:
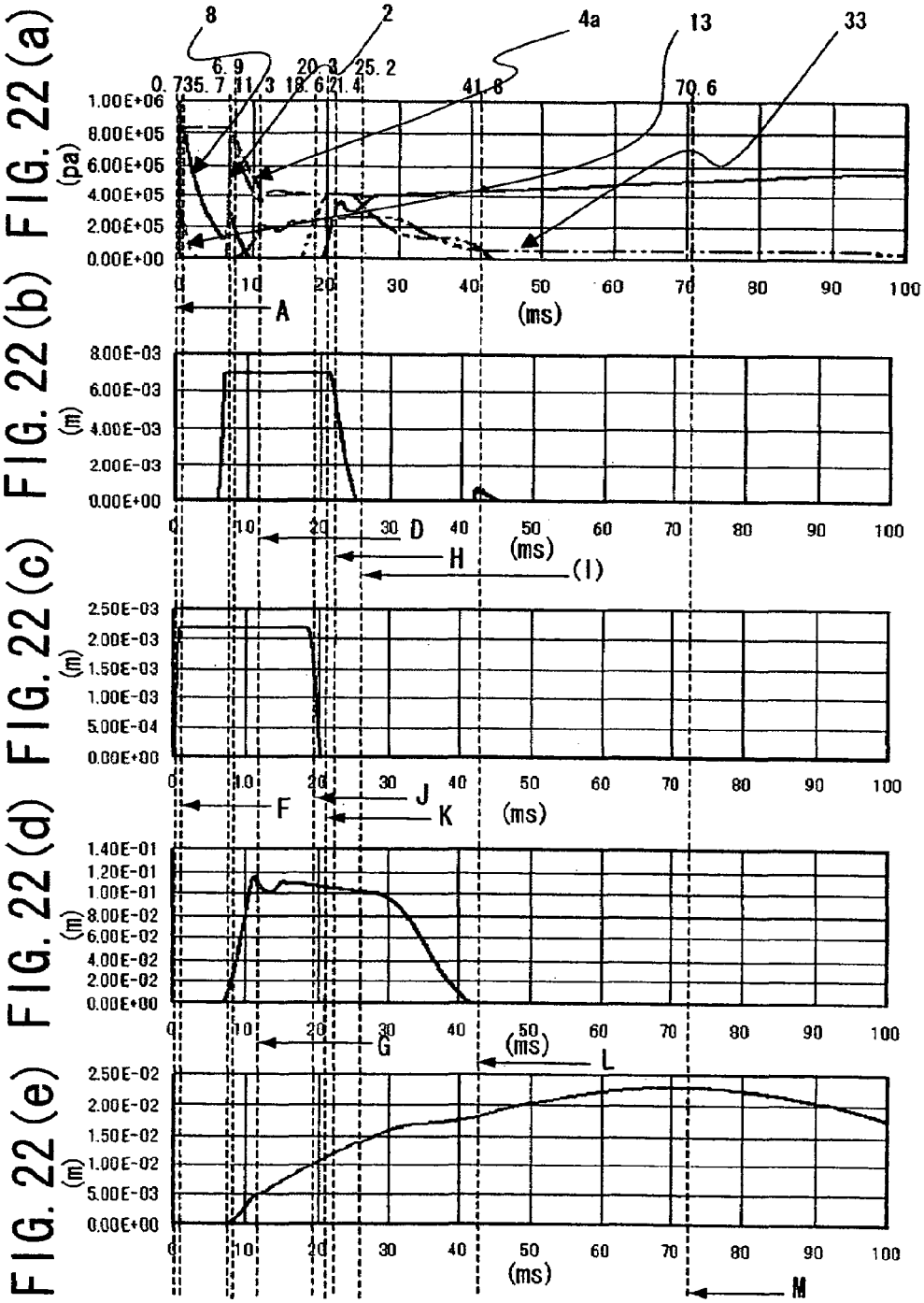
FIG. 22(*a*) is a graph showing the relationship between time and pressure in a trigger valve chamber 13, a main valve chamber 8, an accumulator 2, a piston upper chamber 4*a*, and a return chamber 33 in the fastener driving tool according to the first embodiment.
Figures 23A, 23B, 23C, 23D, 23E:
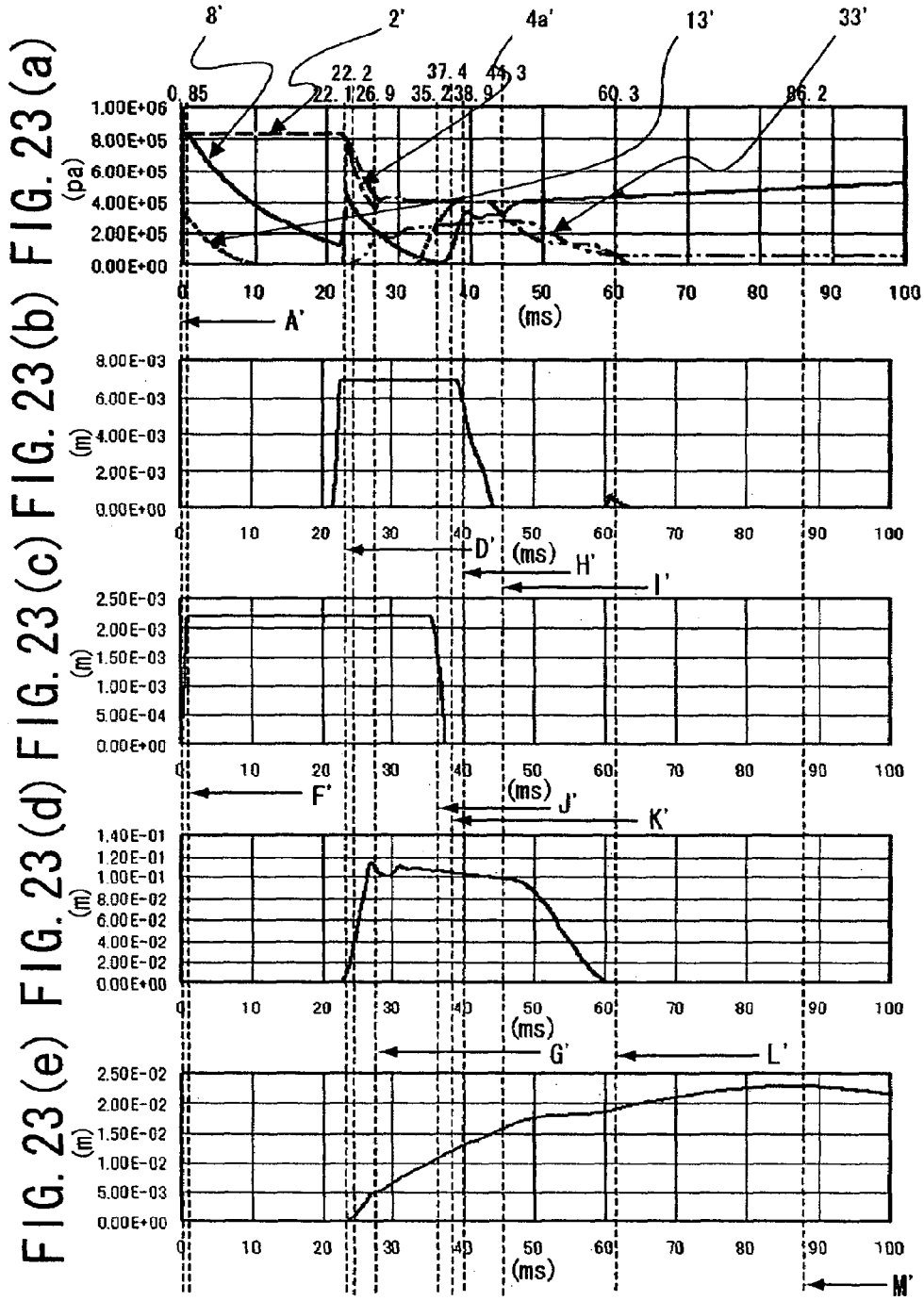
FIG. 23(*a*) is a graph showing the relationship between time and pressure in a trigger valve chamber 13', a main valve chamber 8', an accumulator 2', a piston upper chamber 4*a'*, and a return chamber 33' in another comparative fastener driving tool.

In these graphs, the x-axis represents time, and y-axis in FIG. 22(*a*) represents pressure in the trigger valve chamber 13, the main valve chamber 8, the accumulator 2, the piston 4*a* upper chamber, and the return chamber 33 in the fastener driving tool according to the first embodiment. Further, Y-axes in FIGS. 22(*b*) through 22(*d*) represent a displacement of the main valve 19, a displacement of the valve piston 9, a displacement of the piston 4*a*, and a displacement of a tool itself according to the first embodiment. Here, the origin of the x axis (0 ms) represents the time at which the plunger 7 is pressed and the pressure in the trigger valve chamber 13 begins to drop. The same is true with respect to FIGS. 23(*a*) through (*e*) for another comparative fastener driving tool.

The dimensions in the comparative fastener driving tool involved were; maximum main valve chamber volume V1'=2.621×10$^{-5}$ (m$^3$); main valve control channel cross-sectional area S1'=1.963×10$^{-5}$ (m$^2$); V1'/S1'=1.335; main valve intake channel cross-sectional area Sm'=0.41×10$^{-5}$ (m$^2$); V1'/Sm'=6.5; trigger valve intake channel cross-sectional area St'=1.78×10$^{-6}$ (m$^2$). The dimensions in the fastener driving tool involved in the first embodiment were: maximum main valve chamber 8 volume V1=2.56×10$^{-5}$ (m$^3$); main valve control channel 40 cross-sectional area S1=3.2×10$^{-5}$ (m$^2$); V1/S1=0.8; main valve intake channel 20 cross-sectional area Sm=3.2×10$^{5}$ (m$^2$); V1/Sm=0.8; trigger valve intake channel cross-sectional area St=2.75×10$^{-6}$ (m$^2$).

In FIGS. 22(*a*) through 23(*e*), A through G and A' through G' are the same as those shown in FIGS. 20(*a*) through 21(*d*). H and H' represent the timing at which the returning motion of the main valve is started. I and I' represent the timing at which the main valve is returned to its initial position. J and J' represent the timing at which the returning motion of the valve piston is started. K and K' represent the timing at which the valve piston is returned to its initial position. L and L' represent the timing at which the piston is returned to its initial position. M and M' represent the timing at which the entire tool is displaced by a maximum amount.

In the first embodiment, 6.9 ms was required for starting nail driving by starting the movement of the piston 4*a* whereas the comparative tool required 22.2 ms for the starting (see FIGS. 22(*d*) and 23(*d*). In reaction to the movement of the piston, the tool body itself begins to move upward. Subsequently the piston 4*a* reaches the bottom dead center, and nailing was completed after 11.3 ms in the first embodiment, as opposed to after 26.9 ms in the comparative tool. The upward displacement of both the fastener driving tool 1 and the comparative tool at this point was 5 mm. Further, in the first embodiment, the upward displacement of the tool itself reached 10 mm at 18.6 ms, whereas in the comparative tool, the upward displacement of the tool itself reached 10 mm at 35.1 ms (see FIGS. 22(*e*) and 23(*e*)).

At this point, the relative position between the push lever 42 and the nose 41 was restored to the initial position, and the plunger 7 which has been biased upward by the push lever 42 is returned to its initial position. In the first embodiment, the valve piston 9 began to move due to the pressure of the accumulator 2 and the pressing force of the spring 12 at 18.6 ms, and the valve piston 9 was returned to the initial position at 20.3 ms. On the other hand, in the comparative tool, the valve piston began to move at 35.2 ms, and returned to the initial position at 37.4 ms (See FIGS. 22(*c*) and 23(*c*)).

By the movement of the valve piston 9, the compressed air in the accumulator 2 flows into the main valve chamber 8 through the main valve intake channel 20 and the main valve control channel 40. As a result in the first embodiment, the main valve 19 began to move at 21.4 ms, whereas in the comparative tool, the main valve 19' began to move at 38.9 ms (see H and H'). In addition, in the first embodiment, the main valve 19 was returned to the initial position at its bottom dead center at 25.2 ms, whereas in the comparative tool, the main valve 19' was returned to the initial position at its bottom dead center at 44.3 ms (see I and I'). Simultaneously, the compressed air filled in the piston upper chamber is released to the atmosphere through air channel 29 and the exhaust hole 49, and the tool was returned to the initial state.

As described above, in the first embodiment, the time period from the moment when either the pulling of the trigger 39 is released or the pressing of the push lever 42 against the workpiece is released (18.6 ms) until the main valve is closed (25.2 ms) was 25.2 ms−18.6 ms=6.6 ms. On the other hand, in the comparative tool, the time period was 44.3 ms−35.2 ms=9.1 ms.

In addition, experimentations were conducted using a variety of fastener driving tools for investigating how much the time period needed to be shortened in order for a sufficient improvement on response to be perceived, the time period being from the moment when either the pressing of the trigger 39 was released or the pressing of the push lever 42 against the workpiece is released until the main valve is closed. As a result of experiments, it was found that if the time period is within 7 ms, the response was perceived to be extremely good facilitating driving work and continuous driving.

Therefore, since the first embodiment requires the time period of within 7 ms, the transition to the next nailing operation can proceed rapidly to improve the response. In addition, because of the prompt closure of the main valve, unnecessary air consumption can be avoided.

While the invention has been described in detail and with reference to specific embodiments thereof, it would be apparent to those skilled in the art that various changes and modifications may be made therein without departing from the spirit and scope of the invention.

What is claimed is:

1. A fastener driving tool comprising:

a frame defining therein an accumulator that accumulates a compressed air;

a cylinder disposed within the frame;

a piston reciprocally slidably disposed within the cylinder, a piston upper chamber being defined by an inner peripheral surface of the cylinder and an upper surface of the piston;

a main valve which alternately opens and blocks a fluid communication between the piston upper chamber and the accumulator;

a main valve chamber section defining therein a main valve chamber in which the main valve is movably disposed, the main valve chamber providing a maximum internal volume;

a trigger valve which alternately opens and blocks a fluid communication from the accumulator to the main valve chamber, and a fluid communication from the main valve chamber to an atmosphere; and a main valve control channel section defining therein a main valve control channel that provides a fluid connection between the main valve chamber and the trigger valve, the main valve control channel having a cross-sectional area, a ratio obtained from dividing the maximum internal volume of the main valve chamber measured in $m^3$ by the cross-sectional area of the main valve control channel measured in $m^2$ being not more than 1.0.

2. The fastener driving tool as claimed in claim 1, further comprising:

a push lever in pressure contact with a workpiece; and a trigger functioning as an operation input member; and wherein the main valve is reciprocably movably provided in the main valve chamber for alternately providing a fluid communication between the piston upper chamber and the accumulator and between the piston upper chamber and the atmosphere; and wherein the trigger valve comprises:

a trigger valve exterior frame to which the main valve control channel is fluidly connected;

a valve piston reciprocally slidably disposed within the trigger valve exterior frame and having one end exposed to the accumulator and another end, the valve piston being movable between a top dead center and a bottom dead center, a main valve intake channel being defined between the valve piston and the trigger valve exterior frame for providing fluid connection between the accumulator and the main valve control channel when the valve piston is moved to the upper dead center, and an air discharge channel being defined between the valve piston and the trigger valve exterior frame for providing fluid connection between the main valve control channel and the atmosphere when the valve piston is moved to the bottom dead center, a main valve intake channel and the air discharge channel being alternately opened; and a plunger movable in an axial direction thereof between its top dead center and its bottom dead center and extending through the valve piston and the trigger valve exterior frame, a trigger valve chamber being defined by the trigger valve exterior frame, the another end of the valve piston and the plunger, the air discharge channel having a cross-sectional area not less than the cross-sectional area of the main valve control channel.

3. The fastener driving tool as claimed in claim 2, wherein the main valve intake channel has a cross-sectional area, a ratio obtained from dividing the maximum internal volume of the main valve chamber measured in $m^3$ by the cross-sectional area of the main valve intake channel measured in $m^2$ being not more than 1.0.

4. The fastener driving tool as claimed in claim 2, wherein the plunger has a first section exposed to the accumulator and extending through the valve piston, and a second section extending through the trigger valve exterior frame, a trigger valve intake channel being defined between the first section and the valve piston for providing a fluid connection between the accumulator and the trigger valve chamber when the plunger is moved to its bottom dead center, and a trigger valve control channel being defined between the second section and the trigger valve exterior frame for providing a fluid connection between the trigger valve chamber and the atmosphere when the plunger is moved to its top dead center, the trigger valve intake channel and the trigger valve control channel being alternately opened.

5. The fastener driving tool as claimed in claim 4, wherein the trigger valve intake channel has a cross-sectional area of not less than $3.00\times10^{-6}$ $m^2$.

6. The fastener driving tool as claimed in claim 4, wherein the trigger valve intake channel has a cross-sectional area of not less than $3.25\times10^{-6}$ $m^2$.

7. The fastener driving tool as claimed in claim 4, wherein the trigger valve intake channel has a cross-sectional area of not less than $2.75\times10^{-6}$ $m^2$.

8. The fastener driving tool as claimed in claim 2, wherein a ratio obtained from dividing a maximum volume of the trigger valve chamber measured in $m^3$ by the cross-sectional area of the trigger valve control channel measured in $m^2$ is not more than 0.20.

9. The fastener driving tool as claimed in claim 8, wherein a ratio obtained from dividing the maximum volume of the trigger valve chamber measured in $m^3$ by the cross-sectional area of the trigger valve control channel measured in $m^2$ is not more than 0.15.

10. The fastener driving tool as claimed in claim 9, wherein a ratio obtained from dividing the maximum volume of the trigger valve chamber measured in $m^3$ by the cross-sectional area of the trigger valve control channel measured in $m^2$ is not more than 0.10.

11. The fastener driving tool as claimed in claim 2, wherein a ratio obtained from dividing the maximum internal volume of the main valve chamber measured in $m^3$ by the cross-sectional area of the main valve control channel measured in $m^2$ is not more than 0.8, and wherein a ratio obtained from dividing the maximum internal volume of the main valve chamber measured in $m^3$ by a cross-sectional area of the main valve intake channel measured in $m^2$ is not more than 0.8.

12. The fastener driving tool as claimed in claim 2, wherein a ratio obtained from dividing the maximum internal volume of the main valve chamber measured in $m^3$ by the cross-sectional area of the main valve control channel measured in $m^2$ is not more than 0.6, and wherein a ratio obtained from dividing the maximum internal volume of the main valve chamber measured in $m^3$ by the cross-sectional area of the main valve intake channel measured in $m^2$ is not more than 0.6.

13. The fastener driving tool as claimed in claim 2, wherein the main valve control channel has a curving portion along its path, the curving portion being composed of one of a continuous arcuate portion and discontinuous two bending portions.

14. The fastener driving tool as claimed in claim 13, wherein the two bending portions provide bending angles of not less than 100°.

15. The fastener driving tool as claimed in claim 2, wherein a ratio obtained from dividing the maximum volume of the main valve chamber measured in $m^3$ by the cross-sectional area of the main valve control channel measured in $m^2$ is not more than 0.8.

16. The fastener driving tool as claimed in claim 2, wherein a ratio obtained from dividing the maximum volume of the main valve chamber measured in $m^3$ by the cross-sectional area of the main valve control channel measured in $m^2$ is not more than 0.6.

17. The fastener driving tool as claimed in claim 1, further comprising:

a push lever in pressure contact with a workpiece; and a trigger functioning as an operation input member; and wherein the main valve is reciprocably movably provided in the main valve chamber for alternately providing a fluid communication between the piston upper chamber and the accumulator and between the piston upper chamber and the atmosphere; and wherein the trigger valve comprises:

a trigger valve frame to which the main valve control channel is fluidly connected, the trigger valve frame having a first through hole serving as a main valve intake channel and exposed to the accumulator and a second through hole; and a plunger movable in an axial direction thereof between its top dead center and its bottom dead center relative to the trigger valve frame, the plunger having a first section closing the first through hole when the plunger is moved to its upper dead center for closing the main valve intake channel to shut off fluid communication between the accumulator and the main valve control channel and opening the main valve intake channel to provide communication between the accumulator and the main valve control channel, the plunger also having a second section extending through the second trough hole, an air discharge channel being defined between the second through hole and the second section, the air discharge channel being opened when the plunger is moved to its top dead center to provide fluid communication between the main valve control channel and the atmosphere and being closed when the plunger is moved to its bottom dead center, the main valve intake channel and the air discharge channel being alternately opened by the movement of the plunger.

18. The fastener driving tool as claimed in claim 17, wherein the main valve intake channel has a cross-sectional area, a ratio obtained from dividing the maximum internal volume of the main valve chamber measured in $m^3$ by the cross-sectional area of the main valve intake channel measured in $m^2$ being not more than 1.0.

19. The fastener driving tool as claimed in claim 18, wherein a ratio obtained from dividing the maximum internal volume of the main valve chamber measured in $m^3$ by the cross-sectional area of the main valve control channel measured in $m^2$ is not more than 0.8, and wherein a ratio obtained from dividing the maximum internal volume of the main valve chamber measured in $m^3$ by the cross-sectional area of the main valve intake channel measured in $m^2$ is not more than 0.8.

20. The fastener driving tool as claimed in claim 18, wherein a ratio obtained from dividing the maximum internal volume of the main valve chamber measured in $m^3$ by the cross-sectional area of the main valve control channel measured in $m^2$ is not more than 0.6, and wherein a ratio obtained from dividing the maximum internal volume of the main valve chamber measured in $m^3$ by the cross-sectional area of the main valve intake channel measured in $m^2$ is not more than 0.6.

21. The fastener driving tool as claimed in claim 17, wherein the main valve control channel has a curving portion along its path, the curving portion being composed of one of a continuous arcuate portion and discontinuous two bending portions.

22. The fastener driving tool as claimed in claim 21, wherein the two bending portions provide bending angles of not less than 100°.

23. The fastener driving tool as claimed in claim 17, wherein the air discharge channel has a cross-sectional area equal to or greater than that of the main valve control channel.

24. The fastener driving tool as claimed in claim 17, wherein a ratio obtained from dividing the maximum internal volume of the main valve chamber measured in $m^3$ by the cross-sectional area of the main valve control channel measured in $m^2$ is not more than 0.8.

25. The fastener driving tool as claimed in claim 17, wherein a ratio obtained from dividing the maximum internal volume of the main valve chamber measured in $m^3$ by the cross-sectional area of the main valve control channel measured in $m^2$ is not more than 0.6.

26. A fastener driving tool comprising:

a frame defining therein an accumulator for accumulating a compressed air;

a cylinder disposed within the frame;

a piston reciprocally slidably disposed within the cylinder, a piston upper chamber being defined by the frame, an inner peripheral surface of the cylinder and an upper surface of the piston;

a trigger functioning as an operation input member;

a trigger valve alternately opening and blocking a fluid communication between the piston upper chamber and the accumulator and a fluid communication between the piston upper chamber and an atmosphere, the trigger valve comprising:

a trigger valve exterior frame in fluid communication with the piston upper chamber and formed with a through hole;

a valve piston reciprocably slidably disposed in the trigger valve exterior frame, the valve piston being movable between its top dead center where piston upper chamber is communicated with the atmosphere and its bottom dead center where the piston upper chamber is communicated with the accumulator, the valve piston having a first section exposed to the accumulator and formed with a trigger valve intake channel opened to the accumulator and a second section in sliding contact with the trigger valve exterior frame, a trigger valve chamber being defined by the second section and the trigger valve exterior frame, and providing a maximum internal volume; and a plunger movable between its top dead center and its bottom dead center and having a first portion associated with the valve piston and a second portion associated with the through hole, a trigger valve control channel being formed between the second portion and the through hole and having a cross-sectional area, the trigger valve control channel being opened when the plunger is moved to its top dead center, a ratio obtained from dividing the maximum volume of the trigger valve chamber measured in $m^3$ by the cross-sectional area of the trigger valve control channel measured in $m^2$ being not more than 0.20.

27. The fastener driving tool as claimed in claim 26, wherein the ratio obtained from dividing the maximum volume of the trigger valve chamber measured in $m^3$ by the cross-sectional area of the trigger valve control channel measured in $m^2$ is not more than 0.15.

28. The fastener driving tool as claimed in claim 26, wherein the ratio obtained from dividing the maximum volume of the trigger valve chamber measured in $m^3$ by the cross-sectional area of the trigger valve control channel measured in $m^2$ is not more than 0.1.

29. A fastener driving tool comprising:

a frame defining therein an accumulator for accumulating a compressed air;

a cylinder disposed within the frame;

a piston reciprocally slidably disposed within the cylinder, a piston upper chamber being defined by the frame, an inner peripheral surface of the cylinder and an upper surface of the piston;

a trigger functioning as an operation input member;

a trigger valve alternately opening and blocking a fluid communication between the piston upper chamber and the accumulator and a fluid communication between the piston upper chamber and an atmosphere, the trigger valve comprising:

a trigger valve exterior frame in fluid communication with the piston upper chamber and formed with a through hole;

a valve piston reciprocably slidably disposed in the trigger valve exterior frame, the valve piston being movable between its top dead center where piston upper chamber is communicated with the atmosphere and its bottom dead center where the piston upper chamber is communicated with the accumulator, the valve piston having a first section exposed to the accumulator and formed with a trigger valve intake channel opened to the accumulator and a second section in sliding contact with the trigger valve exterior frame, a trigger valve chamber being defined by the second section and the trigger valve exterior frame and providing a maximum internal volume; and a plunger movable between its top dead center and its bottom dead center and having a first portion associated with the valve piston and a second portion associated with the through hole, a trigger valve control channel being formed between the second portion and the through hole and having a cross-sectional area, the trigger valve control channel being opened when the plunger is moved to its top dead center, the trigger valve intake channel having a cross-sectional area of not less than $2.75\times10^{-6}$ $m^2$, and the trigger valve chamber having a maximum internal volume of $4.0\times10^{-7}$ $m^3$.

30. The fastener driving tool as claimed in claim 29, wherein the trigger valve intake channel has the cross-sectional area of not less than $3.00\times10^{-6}$ $m^2$.

31. The fastener driving tool as claimed in claim 29, wherein the trigger valve intake channel has the cross-sectional area of not less than $3.25\times10^{-6}$ $m^2$.

* * * * *